US011710587B2

(12) United States Patent
Doto et al.

(10) Patent No.: US 11,710,587 B2
(45) **Date of Patent: *Jul. 25, 2023**

(54) R-T-B BASED PERMANENT MAGNET

(71) Applicant: TDK CORPORATION, Tokyo (JP)

(72) Inventors: Hiroshi Doto, Tokyo (JP); Kiyoyuki Masuzawa, Tokyo (JP); Makoto Nakane, Tokyo (JP)

(73) Assignee: TDK CORPORATION, Tokyo (JP)

( * ) Notice: Subject to any disclaimer, the term of this patent is extended or adjusted under 35 U.S.C. 154(b) by 112 days.

This patent is subject to a terminal disclaimer.

(21) Appl. No.: 16/202,936

(22) Filed: Nov. 28, 2018

(65) Prior Publication Data

US 2019/0172616 A1 Jun. 6, 2019

(30) Foreign Application Priority Data

Dec. 5, 2017 (JP) ..... 2017-233828

(51) Int. Cl.
*H01F 1/057* (2006.01)
*H01F 41/02* (2006.01)

(52) U.S. Cl.
CPC ..... *H01F 1/0577* (2013.01); *H01F 41/0293* (2013.01)

(58) Field of Classification Search
None
See application file for complete search history.

(56) References Cited

U.S. PATENT DOCUMENTS 10,672,544 B2 * 6/2020 Masusawa ..... C22C 38/04
2008/0245442 A1 10/2008 Nakamura et al.
2008/0274009 A1 * 11/2008 Tomizawa ..... C22C 38/005 420/83
2010/0233016 A1 * 9/2010 Tsubokura ..... C22C 38/10 420/83
2011/0025440 A1 2/2011 Kuniyoshi et al.
2011/0150691 A1 6/2011 Nakamura et al.
2012/0091844 A1 * 4/2012 Nakajima ..... H01F 1/0577 310/152
2013/0293328 A1 11/2013 Kuniyoshi
2015/0221423 A1 8/2015 Mizoguchi et al.
2017/0103835 A1 * 4/2017 Hidaka ..... H01F 1/0536
2019/0172615 A1 * 6/2019 Doto ..... H01F 1/0577

FOREIGN PATENT DOCUMENTS

CN 104252940 A * 12/2014
CN 104584148 A 4/2015
JP 3080275 B2 8/2000
JP 2009302318 A * 12/2009
JP 2014/160760 A 9/2014
JP 2016184689 A 10/2016
WO 2006/043348 A1 4/2006
WO 2009/122709 A1 10/2009

OTHER PUBLICATIONS

Machine translation of JP 2009-302318A. (Year: 2009).*
Machine translation of CN 104252940A. (Year: 2016).*
Sep. 30, 2022 Office Action issued in Chinese Application No. 201811467513.8.
Preparation Technology of Rare Earth Permanent Magnet Materials, 2nd Edition [M], Edited by Shi Fu and Liu Guozheng, Beijing: Metallurgical Industry Press, Dec. 2013, pp. 204-205.

* cited by examiner

*Primary Examiner* — Xiaowei Su
(74) *Attorney, Agent, or Firm* — Oliff PLC

(57) ABSTRACT

An R-T-B based permanent magnet in which R is a rare earth element, T is Fe and Co, and B is boron. R at least includes Dy. The R-T-B based permanent magnet includes M, and M is at least one or more elements selected from the group consisting of Cu, Ga, Al, Mn, Zr, Ti, Cr, Ni, Nb, Ag, Hf, Ta, W, Si, Bi, and Sn. M at least includes Cu. A total content of R is 28.0 mass % to 30.2 mass %, a content of Dy is 1.0 mass % to 6.5 mass %, a content of Cu is 0.04 mass % to 0.50 mass %, a content of Co is 0.5 mass % to 3.0 mass %, and a content of B is 0.85 mass % to 0.95 mass %.

11 Claims, No Drawings

R-T-B BASED PERMANENT MAGNET

TECHNICAL FIELD

The present invention relates to an R-T-B based permanent magnet.

BACKGROUND

A rare earth permanent magnet having an R-T-B based composition is a magnet showing superior magnetic properties, and many investigations are performed to further improve the magnetic properties. Indexes which show the magnetic properties are generally a residual magnetic flux density (residual magnetization) Br and a coercive force HcJ. A magnet having high values thereof is determined to have superior magnetic properties.

For instance, Patent Document 1 mentions a Nd—Fe—B based rare earth permanent magnet having good magnetic properties and corrosion resistance by adding Dy.

In addition, Patent Document 2 mentions a rare earth permanent magnet, in which a magnet body is immersed in a slurry dispersed with a fine powder including a rare earth element in water or organic solvent, then heated to diffuse the rare earth element into the magnet body along grain boundaries.

[Patent Document 1] JP Patent No. 3080275

[Patent Document 2] a brochure of WO 2006/43348

SUMMARY

An object of the present invention is to provide an R-T-B based permanent magnet showing high residual magnetic flux density and coercive force, and having enhanced effect of improving the coercive force by diffusing a heavy rare earth element to the grain boundaries.

In order to achieve the above object, the R-T-B based permanent magnet of the invention provides, an R-T-B based permanent magnet including M wherein, R is a rare earth element, T is Fe and Co, and B is boron, R at least includes Dy, M is one or more elements selected from Cu, Ga, Al, Mn, Zr, Ti, Cr, Ni, Nb, Ag, Hf, Ta, W, Si, Bi, and Sn, M at least includes Cu, and a total content of R is 28.0 mass % to 30.2 mass %, a content of Dy is 1.0 mass % to 6.5 mass %, a content of Cu is 0.04 mass % to 0.50 mass %, a content of Co is 0.5 mass % to 3.0 mass %, and a content of B is 0.85 mass % to 0.95 mass %.

The R-T-B based permanent magnet of the present invention has high residual magnetic flux density and coercive force by having a composition satisfying the above mentioned range. Further, the R-T-B based permanent magnet has enhanced effect of improving the coercive force by diffusing a heavy rare earth element to the grain boundaries.

The total content of R may be 29.2 mass % to 30.2 mass %.

R may include at least Nd.

R may include at least Pr. A content of Pr may be more than zero to 10.0 mass % or less, and may be 5.0 mass % to 10.0 mass %.

The content of Dy may be 2.5 mass % to 6.5 mass %.

R may at least include Nd and Pr.

M may further include Ga, and a content of Ga may be 0.08 mass % to 0.30 mass %.

M may further include Al, and a content of Al may be 0.15 mass % to 0.30 mass %.

M may further include Zr, and a content of Zr may be 0.10 mass % to 0.30 mass %.

An atomic ratio of TRE/B may be 2.19 to 2.60, where TRE is a total content of R.

An atomic ratio of Pr/TRE may be less than 0.250 (including 0), where TRE is the total content of R.

An atomic ratio of 14B/(Fe+Co) may be more than zero and 1.01 or less.

DETAILED EMBODIMENTS

An embodiment of the invention will be described hereinafter.

<R-T-B Based Permanent Magnet>

The R-T-B based permanent magnet according to the embodiment includes grains made of $R_2T_{14}B$ crystals and grain boundaries thereof. The residual magnetic flux density Br, the coercive force HcJ, a corrosion resistance, and a production stability can be improved by including a plurality of specific elements within a specified range of their content. In addition, an extent of decrease in the residual magnetic flux density Br at a grain boundary diffusion step which will be described in below can be made small, while an extent of increase in the coercive force HcJ can be made large. Namely, the R-T-B based permanent magnet according to the present embodiment shows superior properties even without a grain boundary diffusion step, and also, the R-T-B based permanent magnet is suitable for the grain boundary diffusion step. From the point of improving the coercive force HcJ, the element diffused along the grain boundaries is preferably the heavy rare earth element.

R is the rare earth element. The rare earth element includes Sc, Y and lanthanoids, which belongs to the group III in the long-periodic table. In the present specification, lanthanoids include La, Ce, Pr, Nd, Sm, Eu, Gd, Tb, Dy, Ho, Er, Tm, Yb, and Lu. Also, R preferably includes Nd.

The rare earth elements are generally classified as light rare earth elements and heavy rare earth elements. The heavy rare earth elements of the R-T-B based permanent magnet according to the present embodiment are Gd, Tb, Dy, Ho, Er, Tm, Yb, and Lu.

T is Fe and Co. Also, transition metals which are not included in R or T, and inevitable impurities may be included as well. A content of transition metals which are not included in R or T, and inevitable impurities is preferably 0.1 mass % or less in total, and more preferably it is 0.05 mass % or less. Note that, T does not include C, O, and N.

B is boron.

M is one or more elements selected from the group consisting of Cu, Ga, Al, Mn, Zr, Ti, Cr, Ni, Nb, Ag, Hf, Ta, W, Si, Bi, and Sn. Also, M at least includes Cu.

A total content of R in the R-T-B based permanent magnet of the present embodiment is 28.0 mass % or more and 30.2 mass % or less relative to 100 mass % of a total mass of R, T, B, and M. In case the total content of R is too small, the coercive force HcJ decreases. In case the total content of R is too large, the residual magnetic flux density Br and the corrosion resistance decrease. Further, in case the total content of R is too large, the effect of improving the coercive force HcJ by diffusion of the heavy rare earth metal elements along the grain boundaries decreases. Also, the total content of R may be 29.2 mass % or more and 30.2 mass % or less. When the total content of R is 29.2 mass % or more, a degree of deformation during sintering becomes less, and the production stability improves. As described in below, by making the total content of R within 29.2 mass % or more and 30.2 mass % or less, and also making the content of B within 0.88 mass % or more and 0.95 mass % or less, a squareness ratio Hk/HcJ further improves as well.

A total content of Nd and Pr in the R-T-B based permanent magnet of the present embodiment is not particularly limited. Also, the content of Nd may be zero to 30.2 mass %, zero to 29.7 mass %, 19.7 to 29.7 mass %, 19.7 to 24.7 mass %, or 19.7 to 22.6 mass %, relative to 100 mass % of the total mass of R, T, B, and M. Also, the content of Pr may be zero to 10.0 mass %. Namely, Pr may not be included. The content of Pr may be 5.0 mass % or more and 10.0 mass % or less, and further, it may be 5.0 mass % or more and 7.5 mass % or less. In case the content of Pr is 10.0 mass % or less, the coercive force HcJ has superior temperature coefficient. In particular, to improve the coercive force HcJ at high temperatures, the content of Pr is preferably zero to 7.5 mass %.

Also, the R-T-B based permanent magnet of the present embodiment includes 1.0 mass % or more and 6.5 mass % or less of Dy as R. In case the content of Dy is too small, the coercive force HcJ and the corrosion resistance decrease. In case the content of Dy is too large, the residual magnetic flux density Br decreases, which causes an increase in cost. Also, the content of Dy is preferably 2.5 mass % or more and 6.5 mass % or less. When the content of Dy is 2.5 mass % or more and 6.5 mass % or less, the coercive force HcJ further improves, and also a demagnetization factor at high temperature decreases.

The R-T-B based permanent magnet of the present embodiment may include 0.5 mass % or less of Tb as R. By making the content of Tb to 0.5 mass % or less, good residual magnetic flux density Br is easily maintained.

The demagnetization factor at high temperature in the present specification is defined as described in below. First, a sample is magnetized by a pulse magnetic field of 4,000 kA/m. A total magnetic flux amount of the sample at room temperature (23° C.) is defined as B0. Next, the sample is exposed under a high temperature for 2 hours at 200° C., then the temperature is turned back to room temperature. When the temperature of the sample is back to a room temperature, the total magnetic flux amount is measured again, and this is defined as B1. When D is the demagnetization factor at high temperature of the present specification, D is as shown in below.

$$D=100*(B1-B0)/B0(\%)$$

When an absolute value of the demagnetization factor at high temperature calculated from the above equation is small, this may be simply referred as the demagnetization factor at high temperature is small.

The content of Co is 0.5 mass % or more and 3.0 mass % or less relative to 100 mass % of the total mass of R, T, B, and M. By including Co, the corrosion resistance improves. When the content of Co is less than 0.5 mass %, the corrosion resistance of the R-T-B based permanent magnet obtained at the end will deteriorate. The Co content exceeding 3.0 mass % does not provide a further corrosion resistance enhancing effect and also results in increased cost. Also, the content of Co may be 1.0 mass % or more and 3.0 mass % or less.

The content of B is 0.85 mass % or more and 0.95 mass % or less relative to 100 mass % of the total mass of R, T, B, and M. When the content of B is less than 0.85 mass %, a high squareness ratio becomes difficult to attain. That is, it becomes difficult to improve the squareness ratio Hk/HcJ. When the content of B exceeds 0.95 mass %, the squareness ratio Hk/HcJ after the grain boundary diffusion decreases. Also, the content of B may be 0.88 mass % or more and 0.94 mass % or less. By making the content of B to 0.88 mass % or more, the residual magnetic flux density Br and the squareness ratio Hk/HcJ tend to further increase. By making the content of B to 0.94 mass % or less, the coercive force HcJ tends to further improve.

Although the total M content is not particularly limited, the total M content is preferably 0.04 mass % or more and 1.5 mass % or less based on a total mass of R, T, B, and M of 100 mass %. When the total M content is excessively large, the residual magnetic flux density Br tends to decrease.

The content of Cu is 0.04 mass % or more and 0.50 mass % or less relative to 100 mass % of the total mass of R, T, B, and M. The coercive force HcJ tends to decrease when the content of Cu is less than 0.04 mass %. In addition, the extent of enhancement ΔHcJ of the coercive force HcJ by diffusion of the heavy rare earth element (namely, the grain boundary diffusion) becomes insufficient, and the coercive force HcJ after diffusion of heavy rare earth element tends to further decrease. The coercive force HcJ tends to decrease when the content of Cu exceeds 0.50 mass %, and the residual magnetic flux density Br also tends to decrease. In addition, an extent of enhancement ΔHcJ of the coercive force HcJ by diffusion of the heavy rare earth element may be saturated, and also the residual magnetic flux density Br tends to decrease. In addition, the content of Cu may be 0.10 mass % or more and 0.50 mass % or less, and may be 0.10 mass % or more and 0.30 mass % or less. The corrosion resistance tends to improve when the content of Cu is 0.10 mass % or more.

The content of Ga is 0.08 mass % or more and 0.30 mass % or less relative to 100 mass % of the total mass of R, T, B, and M. The coercive force HcJ can be sufficiently increased when the content of Ga is 0.08 mass % or more. Sub-phases (such as R-T-Ga phase) tend to be easily formed, and the residual magnetic flux density Br tends to decrease when the content of Ga exceeds 0.30 mass %. In addition, the content of Ga may be 0.10 mass % or more and 0.25 mass % or less.

The content of Al is 0.15 mass % or more and 0.30 mass % or less relative to 100 mass % of the total mass of R, T, B, and M. In case the content of Al is 0.15 mass % or more, the coercive force HcJ can be increased. In addition, a difference of the coercive force HcJ due to changes of an aging temperature and/or a heat treatment temperature after diffusion of the heavy rare earth element becomes small, and the properties varies less during mass production. Namely, the production stability improves. The residual magnetic flux density Br before and after diffusion of the heavy rare earth element can be improved when the content of Al is 0.30 mass % or less. The temperature coefficient of the coercive force HcJ can also be improved. The content of Al may be 0.15 mass % or more and 0.25 mass % or less. The difference of the coercive force HcJ due to changes of the aging temperature and/or the heat treatment temperature after diffusion of the heavy rare earth element, becomes even smaller when the content of Al is 0.15 mass % or more and 0.25 mass % or less.

The content of Zr is 0.10 mass % or more and 0.30 mass % or less relative to 100 mass % of the total mass of R, T, B, and M. An abnormal grain growth during sintering can be restricted, and the squareness ratio Hk/HcJ and a magnetization ratio under a low magnetic field can be improved by including Zr. By making the content of Zr to 0.10 mass % or more, the abnormal grain growth restricting effect during sintering is enhanced by including Zr, and the squareness ratio Hk/HcJ and the magnetization ratio under a low magnetic field can be improved. Also, the coercive force HcJ tends to easily improve. By making the content of Zr to 0.30 mass % or less, the residual magnetic flux density Br can be improved. Also, the content of Zr may be 0.15 mass % or more and 0.30 mass % or less, and may be 0.15 mass % or more and 0.25 mass % or less. By making the content of Zr to 0.15 mass % or more, an optimal temperature range for sintering becomes wide. Namely, the abnormal grain growth restricting effect during sintering is further enhanced. Further, the properties vary less, and the production stability improves.

In addition, the R-T-B based permanent magnet according to the present embodiment may include Mn. In case of including Mn, the content of Mn may be 0.02 mass % to 0.10 mass % relative to 100 mass % of the total mass of R, T, B, and M. By making the content of Mn to 0.02 mass % or more, the residual magnetic flux density Br tends to increase and the extent of enhancement ΔHcJ of the coercive force HcJ after diffusion of the heavy rare earth element tends to increase. By making the content of Mn to 0.10 mass % or less, the coercive force HcJ tends to increase, and the extent of enhancement ΔHcJ of the coercive force HcJ after diffusion of the heavy rare earth element tends to increase. The content of Mn may be 0.02 mass % or more and 0.06 mass % or less.

Also, the atomic ratio TRE/B may be 2.19 or more and 2.60 or less, where TRE is the total content of R. When TRE/B is within the above range, the residual magnetic flux density Br and the coercive force HcJ improve. Further, the residual magnetic flux density Br and the coercive force HcJ after the grain boundary diffusion of the heavy rare earth element also improve.

Also, the atomic ratio Pr/TRE may be zero or more and less than 0.25, where TRE is the total content of R element. When Pr/TRE is within the above range, the corrosion resistance tends to improve.

Also, an atomic ratio of 14B/(Fe+Co) may be more than zero and 1.01 or less. The squareness ratio Hk/HcJ after the grain boundary diffusion tends to increase when 14B/(Fe+Co) is 1.01 or less. 14B/(Fe+Co) may be 1.00 or less.

The content of carbon C in the R-T-B based permanent magnet according to the present embodiment may be 1100 ppm or less, 1000 ppm or less, or 900 ppm or less relative to a total mass of the R-T-B based permanent magnet. It may further be 600 to 1100 ppm, 600 to 1000 ppm, or 600 to 900 ppm. The coercive force HcJ before and after diffusion of the heavy rare earth element tends to increase when the content of carbon is 1100 ppm or less. In particular, from the point of improving the coercive force HcJ after diffusion of the heavy rare earth element, the content of carbon can be 900 ppm or less. A production of the R-T-B based permanent magnet having the content of carbon of less than 600 ppm makes process conditions of the R-T-B based permanent magnet to be more difficult, which causes the cost to increase.

Note that, from the point of improving the squareness ratio Hk/HcJ after diffusion of the heavy rare earth element, the content of carbon may be 800 to 1100 ppm.

The content of nitrogen N in the R-T-B based permanent magnet according to the present embodiment may be 1000 ppm or less, 700 ppm or less, or 600 ppm or less relative to a total mass of the R-T-B based permanent magnet. The content of N may be 250 to 1000 ppm, 250 to 700 ppm, or 250 to 600 ppm. The coercive force HcJ tends to become larger as the content of nitrogen decreases. The production of the R-T-B based permanent magnet having the content of nitrogen of less than 250 ppm makes process conditions of the R-T-B based permanent magnet to be more difficult, which causes the cost to increase.

The content of oxygen O in the R-T-B based permanent magnet according to the present embodiment may be 1000 ppm or less, 800 ppm or less, 700 ppm or less, or 500 ppm or less relative to the total mass of the R-T-B based permanent magnet. It may be 350 to 500 ppm. The coercive force HcJ before diffusion of the heavy rare earth element tends to increase as the content of oxygen decreases. The production of the R-T-B based permanent magnet having the content of oxygen of less than 350 ppm makes process conditions of the R-T-B based permanent magnet to become more difficult, which causes the cost to increase. In addition, by making the total content of R to 29.2 mass % or more, and the content of oxygen to 1000 ppm or less, 800 ppm or less, 700 ppm or less, or 500 ppm or less, the deformation during sintering can be restricted and the production stability can be improved. The corrosion resistance can be increased, by making the content of oxygen to 1000 ppm or more, or 3000 ppm or more.

A possible reason that deformation during sintering can be suppressed by reducing the oxygen content while having a predetermined or higher total R content is as follows.

The sintering mechanism of the R-T-B based permanent magnet is a liquid phase sintering, in which grain boundary phase component called R-rich phase melts to form liquid phase during sintering and promotes densification. On the other hand, oxygen easily reacts with the R-rich phase, and as the content of oxygen increases rare earth oxide phase is formed, and the R-rich phase amount decreases. Although in a very small quantity, oxidizing impurity gases generally exist in a sintering furnace. Therefore, during the sintering process, the R-rich phase oxidizes near the surface of a green compact, and the R-rich phase amount may locally decrease. For the composition having large total content of R and small content of oxygen, the R-rich phase amount is large, and an influence of the oxidation on the shrinking behavior during sintering becomes small. For the composition having small content of R and/or large content of oxygen, the oxidization during sintering affects the shrinking behavior because the R-rich phase amount is small. As a result, a sintered body is deformed by partial change in shrinkage, namely, partial change in size. Thus, the deformation during sintering can be suppressed by making the total content of R to a predetermined amount or larger and by decreasing the content of oxygen.

Note that, a measuring method of various components included in the R-T-B based permanent magnet according to the present embodiment can be a conventionally and generally known method. Amounts of various elements can be measured for example by X-ray fluorescence analysis, an inductively coupled plasma atomic emission spectroscopy (ICP analysis), and the like. The content of oxygen is measured for example by an inert gas fusion-nondispersive infrared absorption method. The content of carbon is measured by such as combustion in oxygen stream-infrared absorption method. The content of nitrogen is measured for example by an inert gas fusion-thermal conductivity method.

Further, a content of B+C which is a total content of B and C may be less than 1.050 mass %, 0.920 mass % or more and less than 1.050 mass %, 0.940 mass % or more and less than 1.050 mass %, or 0.960 mass % or more and less than 1.050 mass %. By making the content of B+C to less than 1.050 mass %, the squareness ratio Hk/HcJ before and after diffusion of the heavy rare earth element tends to improve. When the content B+C exceeds 1.050 mass %, the grain boundary phase is insufficiently formed, low coercive force component is locally generated, and the squareness ratio Hk/HcJ decreases.

The R-T-B based permanent magnet of the present embodiment has any shape, such as a rectangular parallelepiped, an arch, or a C shape.

Hereinafter, a manufacturing method of the R-T-B based permanent magnet will be described in detail, however, other known methods can be used.

[Preparation Step of Raw Material Powder]

A raw material powder can be prepared by a known method. A single alloy method using a single alloy will be described in the present embodiment; however, a so called two alloys method may be used to prepare the raw material powder, in which first and second alloys each having different composition are mixed.

First, a raw material alloy of the R-T-B based permanent magnet is prepared (an alloy preparation step). In the alloy preparation step, raw material metals corresponding to the composition of the R-T-B based permanent magnet of the present embodiment are melted by a known method, and then casting is carried out, thereby the raw material alloy having desired composition is prepared.

Examples of the raw material metals which can be used include metals such as rare earth metals or rare earth alloys, pure iron, ferroboron, Co, and Cu; and, moreover, alloys and compounds thereof; and the like. Any method can be used as a casting method for forming raw material metals into a raw material alloy by casting. In order to obtain the R-T-B based permanent magnet having increased magnetic properties, a strip casting method may be used. A homogenization treatment may be performed on the obtained raw material alloy by a known method as necessary.

After preparing the raw material alloy, it is pulverized (pulverizing step). Note that, an atmosphere of each step from the pulverizing step to the sintering step can be a low oxygen concentration atmosphere to obtain higher magnetic properties. For instance, the oxygen concentration in each step can be 200 ppm or less. By controlling the oxygen concentration in each step, an oxygen amount included in the R-T-B based permanent magnet can be controlled.

Below, as a pulverization step, a two-step process is described that includes a coarse pulverization step of pulverizing the alloy to a grain diameter of about several hundred μm to several mm, and a fine pulverization step of finely pulverizing the alloy to a grain diameter of about several jam, while a single-step process consisting solely of a fine pulverization step may be carried out.

In the coarse pulverization step, the raw material alloy is coarsely pulverized till the particle diameter becomes approximately several hundred m to several mm. Thereby, the coarsely pulverized powder is obtained. The coarse pulverization can be carried out by any method, and it can be a known method such as a hydrogen storage pulverization method, a method using a coarse pulverizer, and the like. In case of performing the hydrogen storage pulverization, the nitrogen amount included in the R-T-B based permanent magnet can be controlled by controlling nitrogen gas concentration in an atmosphere during the dehydrogenation treatment.

Next, the obtained coarsely pulverized powder is finely pulverized till the average particle diameter becomes approximately several μm (fine pulverization step). Thereby, a fine pulverized powder (raw material powder) is obtained. The average particle diameter of the fine pulverized powder may be 1 μm or more and 10 μm or less, 2 μm or more and 6 μm or less, or 3 μm or more and 5 μm or less. The nitrogen amount included in the R-T-B based permanent magnet can be controlled by controlling the nitrogen gas concentration in an atmosphere during the fine pulverization process.

The fine pulverization method can be any method. For instance, various kinds of fine pulverizers can be used for the fine pulverization.

When finely pulverizing the coarsely pulverized powder in the fine pulverization step, by adding various pulverization aids such as lauramide, oleyamide, and the like, the fine pulverized powder with high orientation when compacting can be obtained. In addition, the carbon amount included in the R-T-B based permanent magnet can be controlled by varying an amount of the pulverization aids added.

[Compacting Step]

In a compacting step, the above-mentioned fine pulverized powder is compacted to a desired shape. The compacting can be performed by any method. According to the present embodiment, the fine pulverized powder above is filled in a die and pressurized in a magnetic field. The green compact obtained as such has main phase crystals oriented in a specific direction. Therefore, the R-T-B based permanent magnet having higher residual magnetic flux density can be obtained.

The pressure during compacting can be 20 MPa to 300 MPa. The magnetic field applied can be 950 kA/m or more, and 950 kA/m to 1600 kA/m. The magnetic field applied is not limited to a static magnetic field, and it can be a pulse magnetic field. Also, the static magnetic field and the pulse magnetic field can be used together.

As a compacting method, other than dry compacting wherein the fine pulverized powder is directly molded as described above, wet compacting can be applied wherein a slurry obtained by dispersing the fine pulverized powder in a solvent such as oil is molded.

A shape of the green compact obtained by compacting the fine pulverized powder can be any shape. In addition, the density of the green compact at this point can be 4.0 $Mg/m^3$ to 4.3 $Mg/m^3$.

[Sintering Step]

A sintering step is a process in which the green compact is sintered in a vacuum or inert gas atmosphere to obtain the sintered body. Although a sintering temperature needs to be adjusted depending on conditions such as composition, pulverization method, a difference of particle size and particle size distribution and the like, sintering is carried out by heating the green compact for example in vacuum or under inert gas, at 1,000° C. or higher to 1,200° C. or less for one hour or more to 20 hours or less. Thereby, the sintered body with high density can be obtained. In the present embodiment, the sintered body having the density of 7.45 $Mg/m^3$ or more is obtained. The density of the sintered body can be 7.50 $Mg/m^3$ or more.

[Aging Treatment Step]

An aging treatment step is a step in which the sintered body is heat treated at lower temperature than the sintering temperature. There is no particular limitation whether or not to carry out the aging treatment step, and the number of carrying out the aging treatment step is also not particularly limited. The aging treatment step is performed accordingly depending on the desired magnetic properties. In addition, a grain boundary diffusion step which will be described in below may be used as the aging treatment step. For the R-T-B based permanent magnet according to the present embodiment, two steps of the aging treatment is carried out. Hereinafter, the embodiment carrying out the two steps aging treatment is described.

A first-time aging step is referred to as a first aging step, a second-time aging step is referred to as a second aging step, the aging temperature of the first aging step is referred to as T1, and the aging temperature of the second aging step is referred to as T2.

The temperature T1 and the aging time during the first aging step are not particularly limited, and may be 700° C. or more and 900° C. or less and one hour to 10 hours.

The temperature T2 and the aging time during the second aging step are not particularly limited, and may be 450° C. or more and 700° C. or less and one hour to 10 hours.

By such aging treatments, the magnetic properties, especially the coercive force HcJ of the finally obtained R-T-B based permanent magnet can be improved.

The production stability of the R-T-B based permanent magnet of the present embodiment can be confirmed by the difference of the magnetic properties due to the change of the aging temperature. For instance, in case the difference of the magnetic properties due to the change of the aging temperature is large, the magnetic properties change even by a small change of the aging temperature. Therefore, an acceptable range of the aging temperature during the aging step becomes narrow and the production stability becomes low. On the contrary, in case the difference of the magnetic properties due to the change of the aging temperature is small, the magnetic properties scarcely change even if the aging temperature changes. Therefore, the acceptable range of the aging temperature during the aging step becomes wide and the production stability becomes high.

Thus obtained R-T-B based permanent magnet of the present embodiment has desired properties. Specifically, the residual magnetic flux density Br and the coercive force HcJ are high, and the corrosion resistance and the production stability are superior. Moreover, in case the grain boundary diffusion step, which will be described below, is carried out, the extent of decrease in the residual magnetic flux density Br is small and the extent of enhancement of the coercive force HcJ is large when the heavy rare earth element is diffused along the grain boundaries. Namely, the R-T-B based permanent magnet of the present embodiment is a magnet suitable for the grain boundary diffusion.

Note that, the R-T-B based permanent magnet of the present embodiment obtained by the above method becomes an R-T-B based permanent magnet product by magnetizing.

The R-T-B based permanent magnet according to the present embodiment is suitably used for a motor, an electric generator, and the like.

Note that, the invention is not limited to the above described embodiment and can be variously modified within the scope of the invention.

While the R-T-B based permanent magnet can be obtained by the above method, the method for producing the R-T-B based permanent magnet is not limited to the above method, and may be suitably changed. For example, the R-T-B based permanent magnet of the present embodiment may be produced by hot working. A method for producing the R-T-B based permanent magnet by hot working includes the following steps:

(a) a melting and quenching step of melting raw material metals and quenching the resulting molten metal to obtain a ribbon;

(b) a pulverization step of pulverizing the ribbon to obtain a flake-like raw material powder;

(c) a cold forming step of cold-forming the pulverized raw material powder;

(d) a preheating step of preheating the cold-formed body;

(e) a hot forming step of hot-forming the preheated cold-formed body;

(f) a hot plastic deforming step of plastically deforming the hot-formed body into a predetermined shape; and (g) an aging treatment step of aging an R-T-B based permanent magnet.

Hereinafter, a method in which the heavy rare earth element is diffused along the grain boundaries in the R-T-B based permanent magnet of the present embodiment is described.

[Machining Step (Before the Grain Boundary Diffusion)]

A step for machining the R-T-B based permanent magnet according to the present embodiment to a desired shape may be employed if necessary. As examples of the machining method, a shape machining such as cutting and grinding, a chamfering such as barrel polishing, and the like may be mentioned.

The heavy rare earth metal and/or the compound or alloy including the heavy rare earth element or so are adhered on the surface of the R-T-B based permanent magnet by coating, deposition, and the like, then the heat treatment is carried out, thereby the grain boundary diffusion can be carried out. The coercive force HcJ of the finally obtained R-T-B based permanent magnet can be further enhanced by the grain boundary diffusion of the heavy rare earth element.

The heavy rare earth element may be Dy or Tb, and Tb is preferable.

In the embodiments hereinafter, a coating material such as slurry, paste, and the like including the heavy rare earth element is prepared, and the coating material is applied on the surface of the R-T-B based permanent magnet.

The coating material can be in any state. Any heavy rare earth metal and any compound or alloy including the heavy rare earth element can be used. Also, any solvent and dispersant can be used. Further, the concentration of the heavy rare earth element in the coating material can be arbitrary concentration. As the compound including the heavy rare earth element, for example fluoride and hydride can be used.

A diffusion treatment temperature during the grain boundary diffusion step according to the present embodiment can be 800 to 950° C. The diffusion treatment time can be one hour to 50 hours. Note that, the grain boundary diffusion step can be used as the above-mentioned aging treatment process.

An additional heat treatment may be performed after the diffusion treatment. In this case, the heat treatment temperature may be 450 to 600° C. The heat treatment time may be one hour to 10 hours. The magnetic properties, especially the coercive force HcJ, of the finally obtained R-T-B based permanent magnet can be further enhanced by such a heat treatment.

The production stability of the R-T-B based permanent magnet of the present embodiment can be confirmed by the difference of the magnetic properties due to the change of the diffusion treatment temperature during the grain boundary diffusion step and/or the heat treatment temperature after the heavy rare earth element diffusion. Hereinafter, the diffusion treatment temperature during the heavy rare earth element diffusion step is described; however, the same applies to the heat treatment temperature after diffusing the heavy rare earth element. For instance, in case the difference of magnetic properties due to the change of diffusion treatment temperature is large, the magnetic properties change even by a small change of the diffusion treatment temperature. Therefore, an acceptable range of the diffusion treatment temperature during the grain boundary diffusion step becomes narrow, and the production stability becomes low. On the contrary, in case the difference of magnetic properties due to the change of diffusion treatment temperature is small, the magnetic properties scarcely change even when the diffusion treatment temperature changes. Therefore, the acceptable range of the diffusion treatment temperature during the grain boundary diffusion step becomes wide and the production stability becomes high.

[Machining Step (after the Grain Boundary Diffusion)]

Various kinds of the machining may be performed on the R-T-B based permanent magnet after the grain boundary diffusion step. Any kind of machining can be carried out. For example, a shape machining such as cutting and grinding, a chamfering such as barrel polishing, and the like may be carried out.

EXAMPLE

Hereinafter, the R-T-B based permanent magnet of the invention will be described in detail referring to examples; however, the invention is not limited thereto. In the examples described in below, an R-T-B based sintered magnet will be described.

Experiment 1

(Manufacturing R-T-B Based Sintered Magnet)

Nd, Pr, alloy of Dy and Fe, an electrolytic iron, and a low carbon ferroboron alloy were prepared as raw material metals. Further, Al, Ga, Cu, Co, Mn, and Zr were prepared as pure metal, or as an alloy with Fe.

The raw material alloy was prepared using a strip casting method to the above-mentioned raw material metals in order to make the finally obtained magnet composition having the composition of each sample shown in below-mentioned Tables 1, 3, and 5. Also, the thickness of the raw material alloy was 0.2 mm to 0.4 mm. The contents (mass %) of elements other than C, N, and O shown in Tables 1, 3, and 5 were values based on a total mass of R, T, B, and M of 100 mass %.

Subsequently, hydrogen was absorbed into the raw material alloy by flowing hydrogen gas at room temperature for one hour. Then, the atmosphere was changed to Ar gas and the dehydrogenation treatment was performed at 600° C. for one hour to perform the hydrogen storage pulverization to the raw material alloy. Regarding sample numbers 124 to 126, the nitrogen gas concentration in the atmosphere during the dehydrogenation treatment was regulated to make the nitrogen content to a predetermined amount. Subsequently, after cooling, the dehydrogenation treated raw material alloys were sieved to obtain the powder having particle diameter of 425 m or less. Note that, from the hydrogen storage pulverization step to the sintering step which will be described in below, the atmosphere was low oxygen atmosphere in which the oxygen concentration was consistently less than 200 ppm. Regarding sample numbers 117 to 121, the oxygen concentration in the atmosphere was regulated to make the oxygen content to a predetermined amount.

Subsequently, a mass ratio of 0.1% oleyamide was added as the pulverization aid to the raw material alloy powder after the hydrogen storage pulverization and sieving, and then these were mixed. Regarding sample numbers 113 to 116, the amount of the pulverization aid added was regulated in order to make the carbon content to a predetermined amount.

Subsequently, the obtained powder was finely pulverized in a nitrogen gas stream using an impact plate type jet mill apparatus, and the fine powder (raw material powder) having an average particle diameter of 3.9 to 4.2 m was obtained. Regarding samples 122 and 123, the obtained powder was finely pulverized in a mixed gas stream of Ar and nitrogen, and the nitrogen gas concentration was adjusted to make the nitrogen content to a predetermined amount. Note that, the average particle diameter was an average particle diameter D50 measured by a laser diffraction type particle size analyzer.

The obtained fine powder was compacted in the magnetic field and a green compact was manufactured. Here, the magnetic field applied to the obtained fine powder when compacting was a static magnetic field of 1,200 kA/m. The pressure applied during the compacting was 98 MPa. The direction of magnetic field application and the direction of pressurization were perpendicular to each other. The density of the green compact at this point was measured, and all of the green compacts had the density within 4.10 $Mg/m^3$ to 4.25 $Mg/m^3$.

Subsequently, the green compact was sintered and a sintered body was obtained. Optimum conditions of sintering vary depending on the composition and the like; however, sintering was carried out within the temperature range of 1,040° C. to 1,100° C. for four hours. Sintering was carried out in a vacuumed atmosphere. The sintered density at this point was within 7.45 $Mg/m^3$ to 7.55 $Mg/m^3$. Then, in Ar atmosphere under atmospheric pressure, the first aging treatment was performed at the first aging temperature T1=850° C. for one hour and the second aging treatment was further performed at the second aging temperature T2=520° C. for one hour. Accordingly, the R-T-B based sintered magnet of each sample shown in Tables 1, 3, and 5 were obtained.

The composition of the obtained R-T-B based sintered magnet was evaluated by X-ray fluorescence analysis. B as boron was evaluated by ICP analysis. The oxygen content was measured by the inert gas fusion-nondispersive infrared absorption method. The carbon content was measured by the combustion in oxygen stream-infrared absorption method. The nitrogen content was measured by the inert gas fusion-thermal conductivity method. The compositions of each sample were confirmed to be as shown in Tables 1, 3, and 5. The Fe content being balance (bal.) means that the contents of elements not listed in above Tables 1, 3, and 5 were included in the Fe content, and the total of R, T, B, and M was 100 mass %. The C, N, and O contents (ppm) shown in Tables 1, 3, and 5 each indicated the contents based on the total mass of the magnet.

Also, the obtained R-T-B based sintered magnet was ground to 14 mm×10 mm×11 mm (the direction of easy magnetization axis was 11 mm) by a vertical grinding machine, and the residual magnetic flux density Br was evaluated by a BH tracer. Note that, the magnet was magnetized before the measurement by a pulse magnetic field of 4,000 kA/m. In addition, the obtained R-T-B based sintered magnet was ground to 7 mm×7 mm×7 mm by a vertical grinding machine, and the coercive force HcJ was evaluated by a pulse BH tracer. The sample which was used to evaluate the residual magnetic flux density Br and the sample which was used to evaluate the coercive force HcJ were different samples. Note that, the magnet was magnetized before the measurement by a pulse magnetic field of 4,000 kA/m.

Generally, the residual magnetic flux density Br and the coercive force HcJ are in the relationship of a trade-off. Namely, the coercive force HcJ tends to be low as the residual magnetic flux density Br is high, and the residual magnetic flux density Br tends to be low as the coercive force HcJ is high. Thus, for the present example, a performance index PI(Potential Index) was set to comprehensively evaluate the residual magnetic flux density Br and the coercive force HcJ. The following equation was defined where the magnitude of the residual magnetic flux density measured by mT unit was Br (mT), and the magnitude of the coercive force measured by kA/m unit was HcJ (kA/m).

$$PI=Br+25\times HcJ\times 4\pi/2{,}000$$

For the present example, when Br≥1240 mT, HcJ≥1400 kA/m, and PI≥1630 were satisfied before diffusion of Tb which is described in below, the residual magnetic flux density Br and the coercive force HcJ before diffusion of Tb were considered good. Also, when the squareness ratio Hk/HcJ before diffusion of Tb was 95.0% or more, it was considered good. When the squareness ratio Hk/HcJ after diffusion of Tb was 95.0% or more, it was considered good. Note that, the squareness ratio Hk/HcJ in the present example was calculated by Hk/HcJ (%) when Hk (kA/m) is the magnitude of the magnetic field when the magnetization reaches 90% of Br in the second quadrant (J-H demagnetization curve) of a magnetization J—magnetic field H curve. Then, J-H curve was measured using a BH tracer at the measuring temperature of 200° C.; thereby the squareness ratio Hk/HcJ was calculated.

When a sample satisfied Br≥1240 mT, HcJ≥1400 kA/m, PI≥1630, and Hk/HcJ≥95.0% before diffusion of Tb which is described in below, such sample was considered good and it was shown by a symbol "○". If the sample did not satisfy any one of the above properties, then it was shown by a symbol of "x". Note that, when HcJ≥1500 kA/m and Hk/HcJ of 98.0% or more were satisfied, then particularly superior demagnetizing force resistance was attained.

In addition, the corrosion resistance of each sample was tested. The corrosion resistance was tested by PCT test (Pressure Cooker Test) under saturated vapor pressure. Specifically, a mass change of the R-T-B based sintered magnet before and after the test under pressure of 2 atm for 1,000 hours in 100% RH atmosphere was measured. The corrosion resistance was considered good when the mass decrease per a total surface area of the magnet was 3 mg/cm$^2$ or less. The corrosion resistance was considered particularly good when the mass decrease was 2 mg/cm$^2$ or less. The samples showed the corrosion resistance of particularly good, good, and poor, which were shown by the symbols "◎", "○" and "x", respectively. Note that, none of the samples tested for the corrosion resistance showed "poor" for the corrosion resistance.

Further, for each sample, the demagnetization factor at high temperature was measured. First, the sample was ground into a shape having a permeance coefficient of 0.5. Then, the sample was magnetized by the pulse magnetic field of 4,000 kA/m, and the total magnetic flux amount of the sample at room temperature (23° C.) was measured. This was defined as B0. The total magnetic flux amount was for example measured by a flux meter and the like. Next, the sample was exposed under high temperature of 200° C. for 2 hours, and then turned back to room temperature. Once the temperature of the sample turned back to room temperature, the total magnetic flux amount was measured again, and this was defined as B1. When the demagnetization factor at high temperature was D (%), the following equation was satisfied.

$$D=100\times(B1-B0)/B0(\%)$$

When the absolute value of the demagnetization factor at high temperature before diffusion of Tb is 50% or less, then it was considered good.

(Tb Diffusion)

Further, the obtained R-T-B based sintered magnet was ground to 14 mm×10 mm×4.2 mm (the direction of easy magnetization axis was 4.2 mm). Then, the etching treatment was carried out by immersing the R-T-B based sintered magnet for 3 minutes in a mixed solution of nitric acid and ethanol including 3 mass % of nitric acid with respect to 100 mass % of ethanol, and then immersing in ethanol for one minute. The etching treatment of immersing for 3 minutes in the mixed solution and one minute in ethanol was repeated twice. Subsequently, a slurry having $TbH_2$ particles (average particle diameter D50=10.0 m) dispersed in ethanol was applied on entire surface of the R-T-B sintered magnet after the etching treatment so that a mass ratio of Tb with relative to a mass of the sintered magnet was 0.6 mass %.

After applying and drying the slurry, the diffusion treatment was performed in flowing Ar atmosphere (1 atm) at 930° C. for 18 hours, and then the heat treatment was performed at 520° C. for four hours.

The R-T-B based sintered magnet after the heat treatment was ground and the magnetic properties were evaluated. Note that, the magnetic properties were evaluated after magnetizing by 4,000 kA/m pulse magnetic field. For the measurement of the residual magnetic flux density Br, each surface of the magnet was ground to form 13.8 mm×9.8 mm×4 mm, then three sintered magnets were layered one on top of the other, then the residual magnetic flux density Br was measured by a BH tracer. For the measurement of the coercive force HcJ, the entire surface of the magnet was evenly ground to form 7 mm×7 mm×4 mm, and using one magnet, the coercive force HcJ was measured by a pulse BH tracer. After diffusion of Tb, when samples satisfied Br≥1230 mT, HcJ≥2150 kA/m, PI≥1740, and Hk/HcJ≥95.0%, such sample was considered good and it was shown by a symbol "○". If the sample did not satisfy any one of the above properties, then it was shown by a symbol of "x". Note that, it was particularly preferable when HcJ≥2250 kA/m.

Also, the demagnetization factor at high temperature after diffusion of Tb was measured. The method of measuring the demagnetization factor at high temperature was the same as the method measuring the demagnetization factor at high temperature before diffusion of Tb. When the absolute value of the demagnetization factor at high temperature after diffusion of Tb was less than 1%, then it was considered good.

Further, in each Table, the difference of the residual magnetic flux density Br before and after diffusion of Tb was shown by ΔBr, and the difference of the coercive force HcJ before and after diffusion of Tb was shown by ΔHcJ. In the present embodiment, the difference of residual magnetic flux density Br due to Tb diffusion was defined as ΔBr and the difference of coercive force due to Tb diffusion was defined as ΔHcJ. Namely, ΔBr=(Br after Tb diffusion)−(Br before Tb diffusion). Similarly, ΔHcJ=(HcJ after Tb diffusion)−(HcJ before Tb diffusion). When ΔBr≥−15 mT and ΔHcJ≥700 kA/m were satisfied, it was considered that the effect of improving the coercive force HcJ by diffusion of the heavy rare earth element into the grain boundary was large.

TABLE 1

| | R-T-B based sintered magnet compostion (before Tb diffusion) | | | | | | | | | | | | | | | | | | |
|---|---|---|---|---|---|---|---|---|---|---|---|---|---|---|---|---|---|---|---|
| | R | | | | | T | | | TRE/B | Pr/TRE | 14B/ (Fe + Co) | M | | | | | | | |
| Sample No. | Nd (mass %) | Pr (mass %) | Tb (mass %) | Dy (mass %) | TRE | Co (mass %) | Fe (mass %) | B (mass %) | (atomic ratio) | (atomic ratio) | (atomic ratio) | Al (mass %) | Ga (mass %) | Cu (mass %) | Mn (mass %) | Zr (mass %) | C (ppm) | N (ppm) | O (ppm) |
| 1* | 20.5 | 6.9 | 0.0 | 3.3 | ***30.7*** | 2.0 | bal. | ***0.96*** | 2.38 | 0.232 | 1.03 | 0.20 | 0.20 | 0.20 | 0.03 | 0.15 | 900 | 500 | 500 |
| 2* | 20.5 | 6.9 | 0.0 | 3.3 | ***30.7*** | 2.0 | bal. | 0.95 | 2.41 | 0.232 | 1.02 | 0.20 | 0.20 | 0.20 | 0.03 | 0.15 | 900 | 500 | 500 |
| 3* | 20.5 | 6.9 | 0.0 | 3.3 | ***30.7*** | 2.0 | bal. | 0.94 | 2.43 | 0.232 | 1.01 | 0.20 | 0.20 | 0.20 | 0.03 | 0.15 | 900 | 500 | 500 |
| 4* | 20.5 | 6.9 | 0.0 | 3.3 | ***30.7*** | 2.0 | bal. | 0.93 | 2.46 | 0.232 | 1.00 | 0.20 | 0.20 | 0.20 | 0.03 | 0.15 | 900 | 500 | 500 |
| 5* | 20.5 | 6.9 | 0.0 | 3.3 | ***30.7*** | 2.0 | bal. | 0.90 | 2.54 | 0.232 | 0.96 | 0.20 | 0.20 | 0.20 | 0.03 | 0.15 | 900 | 500 | 500 |
| 6* | 20.5 | 6.9 | 0.0 | 3.3 | ***30.7*** | 2.0 | bal. | 0.88 | 2.60 | 0.232 | 0.94 | 0.20 | 0.20 | 0.20 | 0.03 | 0.15 | 900 | 500 | 500 |
| 7* | 20.5 | 6.9 | 0.0 | 3.3 | ***30.7*** | 2.0 | bal. | 0.85 | 2.69 | 0.232 | 0.91 | 0.20 | 0.20 | 0.20 | 0.03 | 0.15 | 900 | 500 | 500 |
| 8* | 20.2 | 6.7 | 0.0 | 3.3 | 30.2 | 2.0 | bal. | ***0.96*** | 2.34 | 0.229 | 1.02 | 0.20 | 0.20 | 0.20 | 0.03 | 0.15 | 900 | 500 | 500 |
| 9 | 20.2 | 6.7 | 0.0 | 3.3 | 30.2 | 2.0 | bal. | 0.95 | 2.37 | 0.229 | 1.01 | 0.20 | 0.20 | 0.20 | 0.03 | 0.15 | 900 | 500 | 500 |
| 10 | 20.2 | 6.7 | 0.0 | 3.3 | 30.2 | 2.0 | bal. | 0.94 | 2.39 | 0.229 | 1.00 | 0.20 | 0.20 | 0.20 | 0.03 | 0.15 | 900 | 500 | 500 |
| 11 | 20.2 | 6.7 | 0.0 | 3.3 | 30.2 | 2.0 | bal. | 0.93 | 2.42 | 0.229 | 0.99 | 0.20 | 0.20 | 0.20 | 0.03 | 0.15 | 900 | 500 | 500 |
| 12 | 20.2 | 6.7 | 0.0 | 3.3 | 30.2 | 2.0 | bal. | 0.90 | 2.50 | 0.229 | 0.96 | 0.20 | 0.20 | 0.20 | 0.03 | 0.15 | 900 | 500 | 500 |
| 13 | 20.2 | 6.7 | 0.0 | 3.3 | 30.2 | 2.0 | bal. | 0.88 | 2.55 | 0.229 | 0.94 | 0.20 | 0.20 | 0.20 | 0.03 | 0.15 | 900 | 500 | 500 |
| 14* | 19.8 | 6.6 | 0.0 | 3.3 | 29.7 | 2.0 | bal. | ***0.96*** | 2.30 | 0.229 | 1.01 | 0.20 | 0.20 | 0.20 | 0.03 | 0.15 | 900 | 500 | 500 |
| 15 | 19.8 | 6.6 | 0.0 | 3.3 | 29.7 | 2.0 | bal. | 0.95 | 2.33 | 0.229 | 1.00 | 0.20 | 0.20 | 0.20 | 0.03 | 0.15 | 900 | 500 | 500 |
| 16 | 19.8 | 6.6 | 0.0 | 3.3 | 29.7 | 2.0 | bal. | 0.94 | 2.35 | 0.229 | 0.99 | 0.20 | 0.20 | 0.20 | 0.03 | 0.15 | 900 | 500 | 500 |
| 17 | 19.8 | 6.6 | 0.0 | 3.3 | 29.7 | 2.0 | bal. | 0.93 | 2.38 | 0.229 | 0.98 | 0.20 | 0.20 | 0.20 | 0.03 | 0.15 | 900 | 500 | 500 |
| 18 | 19.8 | 6.6 | 0.0 | 3.3 | 29.7 | 2.0 | bal. | 0.90 | 2.46 | 0.229 | 0.95 | 0.20 | 0.20 | 0.20 | 0.03 | 0.15 | 900 | 500 | 500 |
| 19 | 19.8 | 6.6 | 0.0 | 3.3 | 29.7 | 2.0 | bal. | 0.88 | 2.51 | 0.229 | 0.93 | 0.20 | 0.20 | 0.20 | 0.03 | 0.15 | 900 | 500 | 500 |
| 20 | 19.8 | 6.6 | 0.0 | 3.3 | 29.7 | 2.0 | bal. | 0.85 | 2.60 | 0.229 | 0.90 | 0.20 | 0.20 | 0.20 | 0.03 | 0.15 | 900 | 500 | 500 |
| 21* | 19.4 | 6.5 | 0.0 | 3.3 | 29.2 | 2.0 | bal. | ***0.96*** | 2.26 | 0.230 | 1.01 | 0.20 | 0.20 | 0.20 | 0.03 | 0.15 | 900 | 500 | 500 |
| 22 | 19.4 | 6.5 | 0.0 | 3.3 | 29.2 | 2.0 | bal. | 0.95 | 2.29 | 0.230 | 1.00 | 0.20 | 0.20 | 0.20 | 0.03 | 0.15 | 900 | 500 | 500 |
| 23 | 19.4 | 6.5 | 0.0 | 3.3 | 29.2 | 2.0 | bal. | 0.94 | 2.31 | 0.230 | 0.99 | 0.20 | 0.20 | 0.20 | 0.03 | 0.15 | 900 | 500 | 500 |
| 24 | 19.4 | 6.5 | 0.0 | 3.3 | 29.2 | 2.0 | bal. | 0.93 | 2.34 | 0.230 | 0.98 | 0.20 | 0.20 | 0.20 | 0.03 | 0.15 | 900 | 500 | 500 |
| 25 | 19.4 | 6.5 | 0.0 | 3.3 | 29.2 | 2.0 | bal. | 0.90 | 2.41 | 0.230 | 0.94 | 0.20 | 0.20 | 0.20 | 0.03 | 0.15 | 900 | 500 | 500 |
| 26 | 19.4 | 6.5 | 0.0 | 3.3 | 29.2 | 2.0 | bal. | 0.88 | 2.47 | 0.230 | 0.92 | 0.20 | 0.20 | 0.20 | 0.03 | 0.15 | 900 | 500 | 500 |
| 27 | 19.4 | 6.5 | 0.0 | 3.3 | 29.2 | 2.0 | bal. | 0.85 | 2.56 | 0.230 | 0.89 | 0.20 | 0.20 | 0.20 | 0.03 | 0.15 | 900 | 500 | 500 |
| 28* | 19.2 | 6.4 | 0.0 | 3.3 | 28.9 | 2.0 | bal. | ***0.96*** | 2.24 | 0.228 | 1.00 | 0.20 | 0.20 | 0.20 | 0.03 | 0.15 | 900 | 500 | 500 |
| 29 | 19.2 | 6.4 | 0.0 | 3.3 | 28.9 | 2.0 | bal. | 0.95 | 2.26 | 0.228 | 0.99 | 0.20 | 0.20 | 0.20 | 0.03 | 0.15 | 900 | 500 | 500 |
| 30 | 19.2 | 6.4 | 0.0 | 3.3 | 28.9 | 2.0 | bal. | 0.94 | 2.29 | 0.228 | 0.98 | 0.20 | 0.20 | 0.20 | 0.03 | 0.15 | 900 | 500 | 500 |
| 31 | 19.2 | 6.4 | 0.0 | 3.3 | 28.9 | 2.0 | bal. | 0.93 | 2.31 | 0.228 | 0.97 | 0.20 | 0.20 | 0.20 | 0.03 | 0.15 | 900 | 500 | 500 |
| 32 | 19.2 | 6.4 | 0.0 | 3.3 | 28.9 | 2.0 | bal. | 0.90 | 2.39 | 0.228 | 0.94 | 0.20 | 0.20 | 0.20 | 0.03 | 0.15 | 900 | 500 | 500 |
| 33 | 19.2 | 6.4 | 0.0 | 3.3 | 28.9 | 2.0 | bal. | 0.88 | 2.44 | 0.228 | 0.92 | 0.20 | 0.20 | 0.20 | 0.03 | 0.15 | 900 | 500 | 500 |
| 34 | 19.2 | 6.4 | 0.0 | 3.3 | 28.9 | 2.0 | bal. | 0.85 | 2.53 | 0.228 | 0.89 | 0.20 | 0.20 | 0.20 | 0.03 | 0.15 | 900 | 500 | 500 |
| 35* | 18.5 | 6.2 | 0.0 | 3.3 | 28.0 | 2.0 | bal. | ***0.96*** | 2.17 | 0.228 | 0.99 | 0.20 | 0.20 | 0.20 | 0.03 | 0.15 | 900 | 500 | 500 |
| 36 | 18.5 | 6.2 | 0.0 | 3.3 | 28.0 | 2.0 | bal. | 0.95 | 2.19 | 0.228 | 0.98 | 0.20 | 0.20 | 0.20 | 0.03 | 0.15 | 900 | 500 | 500 |
| 37 | 18.5 | 6.2 | 0.0 | 3.3 | 28.0 | 2.0 | bal. | 0.94 | 2.21 | 0.228 | 0.97 | 0.20 | 0.20 | 0.20 | 0.03 | 0.15 | 900 | 500 | 500 |
| 38 | 18.5 | 6.2 | 0.0 | 3.3 | 28.0 | 2.0 | bal. | 0.93 | 2.24 | 0.228 | 0.96 | 0.20 | 0.20 | 0.20 | 0.03 | 0.15 | 900 | 500 | 500 |
| 39 | 18.5 | 6.2 | 0.0 | 3.3 | 28.0 | 2.0 | bal. | 0.90 | 2.31 | 0.228 | 0.93 | 0.20 | 0.20 | 0.20 | 0.03 | 0.15 | 900 | 500 | 500 |
| 40 | 18.5 | 6.2 | 0.0 | 3.3 | 28.0 | 2.0 | bal. | 0.88 | 2.37 | 0.228 | 0.91 | 0.20 | 0.20 | 0.20 | 0.03 | 0.15 | 900 | 500 | 500 |

*indicates comparative example

TABLE 2

| | Before Tb diffusion | | | | | | | Difference due to Tb diffusion | | After Tb diffusion | | | | | |
|---|---|---|---|---|---|---|---|---|---|---|---|---|---|---|---|
| Sample No. | Br (mT) | HcJ (kA/m) | PI | Hk/HcJ (%) | Demagnetization factor at high temperature (%) | PI, Hk/HcJ Evaluation | Corrosion resistance | Δ Br (mT) | Δ HcJ (kA/m) | Br (mT) | HcJ (kA/m) | PI | Hk/HcJ (%) | Demagnetization factor at high temperature (%) | PI, Hk/HcJ Evaluation |
| 1* | 1340 | 1814 | ***1625*** | 98.9 | −27 | X | ○ | −9 | ***699*** | 1331 | 2513 | ***1726*** | ***92.1*** | 0 | X |
| 2* | 1339 | 1825 | ***1626*** | 98.8 | −26 | X | ○ | −5 | 701 | 1334 | 2526 | ***1731*** | 97.8 | 0 | X |
| 3* | 1333 | 1843 | ***1627*** | 98.8 | −25 | X | ○ | −7 | 708 | 1331 | 2551 | ***1732*** | 97.8 | 0 | X |
| 4* | 1334 | 1856 | ***1626*** | 98.9 | −24 | X | ○ | −6 | 705 | 1328 | 2561 | ***1730*** | 97.8 | 0 | X |
| 5* | 1335 | 1869 | ***1629*** | 98.7 | −23 | X | ○ | −6 | ***695*** | 1329 | 2564 | ***1732*** | 97.3 | 0 | X |
| 6* | 1332 | 1891 | ***1629*** | 98.5 | −21 | X | ○ | −6 | ***683*** | 1326 | 2574 | ***1730*** | 97.8 | 0 | X |
| 7* | 1322 | 1838 | ***1611*** | 98.4 | −24 | X | ○ | −8 | ***678*** | 1314 | 2516 | ***1709*** | 97.2 | 0 | X |
| 8* | 1352 | 1797 | 1634 | 98.7 | −28 | ○ | ◎ | −8 | 723 | 1344 | 2520 | 740 | ***86.5*** | 0 | X |
| 9 | 1349 | 1793 | 1631 | 98.7 | −28 | ○ | ◎ | −6 | 735 | 1343 | 2528 | 1740 | 98.0 | 0 | ○ |
| 10 | 1350 | 1807 | 1634 | 98.8 | −27 | ○ | ◎ | −6 | 738 | 1344 | 2545 | 1744 | 98.5 | 0 | ○ |
| 11 | 1350 | 1823 | 1636 | 98.8 | −26 | ○ | ◎ | −9 | 726 | 1341 | 2549 | 1741 | 98.7 | 0 | ○ |
| 12 | 1347 | 1856 | 1639 | 98.5 | −24 | ○ | ◎ | −10 | 719 | 1337 | 2575 | 1741 | 98.3 | 0 | ○ |
| 13 | 1345 | 1854 | 1636 | 98.5 | −24 | ○ | ◎ | −7 | 708 | 1338 | 2562 | 1740 | 98.3 | 0 | ○ |
| 14* | 1368 | 1739 | 1641 | 99.5 | −32 | ○ | ◎ | −6 | 762 | 1362 | 2501 | 1755 | ***85.9*** | 0 | X |
| 15 | 1367 | 1749 | 1642 | 99.5 | −31 | ○ | ◎ | −5 | 766 | 1362 | 2515 | 1757 | 98.1 | 0 | ○ |
| 16 | 1368 | 1785 | 1648 | 99.5 | −29 | ○ | ◎ | −6 | 762 | 1362 | 2547 | 1762 | 98.1 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 18 | 1363 | 1828 | 1650 | 99.4 | −26 | ○ | ◎ | −5 | 745 | 1358 | 2573 | 1762 | 98.0 | 0 | ○ |
| 19 | 1361 | 1842 | 1650 | 99.0 | −25 | ○ | ◎ | −5 | 724 | 1356 | 2566 | 1759 | 98.1 | 0 | ○ |
| 20 | 1351 | 1814 | 1636 | 98.9 | −27 | ○ | ◎ | −7 | 714 | 1344 | 2528 | 1741 | 98.0 | 0 | ○ |
| 21* | 1380 | 1697 | 1647 | 99.2 | −35 | ○ | ◎ | −4 | 770 | 1376 | 2467 | 1764 | ***83.2*** | 0 | X |
| 22 | 1377 | 1714 | 1646 | 98.9 | −34 | ○ | ◎ | −4 | 780 | 1373 | 2494 | 1765 | 97.8 | 0 | ○ |
| 23 | 1376 | 1727 | 1647 | 99.0 | −33 | ○ | ◎ | −3 | 781 | 1373 | 2508 | 1767 | 98.8 | 0 | ○ |
| 24 | 1376 | 1746 | 1650 | 99.1 | −32 | ○ | ◎ | −5 | 778 | 1371 | 2524 | 1767 | 99.1 | 0 | ○ |
| 25 | 1370 | 1788 | 1651 | 98.8 | −29 | ○ | ◎ | −6 | 760 | 1364 | 2548 | 1764 | 99.0 | 0 | ○ |
| 26 | 1369 | 1805 | 1653 | 93.9 | −28 | ○ | ◎ | −6 | 743 | 1363 | 2548 | 1763 | 98.9 | 0 | ○ |
| 27 | 1357 | 1748 | 1632 | 98.5 | −31 | ○ | ◎ | −5 | 732 | 1352 | 2480 | 1742 | 97.8 | 0 | ○ |
| 28* | 1384 | 1672 | 1647 | 99.2 | −37 | ○ | ◎ | −12 | 780 | 1372 | 2452 | 1757 | ***89.4*** | 0 | X |
| 29 | 1385 | 1677 | 1648 | 98.3 | −36 | ○ | ◎ | −8 | 789 | 1377 | 2466 | 1764 | 97.7 | 0 | ○ |
| 30 | 1388 | 1691 | 1654 | 98.4 | −36 | ○ | ◎ | −9 | 791 | 1379 | 2482 | 1769 | 97.2 | 0 | ○ |
| 31 | 1382 | 1722 | 1652 | 98.3 | −31 | ○ | ◎ | −6 | 790 | 1376 | 2512 | 1771 | 97.3 | 0 | ○ |
| 32 | 1386 | 1759 | 1662 | 98.9 | −31 | ○ | ◎ | −14 | 767 | 1372 | 2526 | 1769 | 95.7 | 0 | ○ |
| 33 | 1382 | 1774 | 1661 | 98.0 | −30 | ○ | ◎ | −12 | 750 | 1370 | 2524 | 1766 | 96.0 | 0 | ○ |
| 34 | 1371 | 1735 | 1644 | 97.7 | −32 | ○ | ◎ | −11 | 737 | 1360 | 2472 | 1748 | 95.5 | 0 | ○ |
| 35* | 1378 | 1592 | 1628 | 99.0 | −42 | X | ◎ | −10 | 780 | 1368 | 2372 | 1741 | ***89.1*** | 0 | X |
| 36 | 1378 | 1605 | 1630 | 99.1 | −41 | ○ | ◎ | −4 | 792 | 1374 | 2397 | 1751 | 99.0 | 0 | ○ |
| 37 | 1378 | 1619 | 1632 | 98.9 | −40 | ○ | ◎ | −9 | 793 | 1369 | 2412 | 1748 | 98.4 | 0 | ○ |
| 38 | 1377 | 1655 | 1637 | 98.7 | −38 | ○ | ◎ | −12 | 790 | 1365 | 2445 | 1749 | 98.5 | 0 | ○ |
| 39 | 1377 | 1673 | 1640 | 98.8 | −37 | ○ | ◎ | −9 | 774 | 1368 | 2447 | 1752 | 98.2 | 0 | ○ |
| 40 | 1374 | 1673 | 1637 | 98.5 | −36 | ○ | ◎ | −8 | 755 | 1368 | 2428 | 1747 | 98.0 | 0 | ○ |

*indicates comparative example

Δ Br = (Br after Tb diffusion) − (Br before Tb diffusion)

Δ HcJ = (HcJ after Tb diffusion) − (HcJ before Tb diffusion)

TABLE 3

| | R-T-B based sntered magnet composition (before Tb diffusion) | | | | | | | | | | | | | | | | | | |
|---|---|---|---|---|---|---|---|---|---|---|---|---|---|---|---|---|---|---|---|
| | R | | | | | T | | | TRE/B | Pr/TRE | 14B/ | M | | | | | | | |
| Sample No. | Nd (mass %) | Pr (mass %) | Tb (mass %) | Dy (mass %) | TRE (mass %) | Co (mass %) | Fe mass %) | B (mass %) | (atomic rato) | (atomic rato) | (Fe + Co) (mass %) | Al (mass %) | Ga (mass %) | Cu (mass %) | Mn (mass %) | Zr (mass %) | C (ppm) | N (ppm) | O (ppm) |
| *41 | 17.0 | 5.7 | 0.0 | ***7.5*** | 30.2 | 2.0 | bal. | 0.90 | 2.46 | 0.198 | 0.96 | 0.20 | 0.20 | 0.20 | 0.03 | 0.15 | 900 | 500 | 500 |
| 42 | 17.8 | 5.9 | 0.0 | 6.5 | 30.2 | 2.0 | bal. | 0.90 | 2.47 | 0.204 | 0.96 | 0.20 | 0.20 | 0.20 | 0.03 | 0.15 | 900 | 500 | 500 |
| 43 | 18.1 | 6.1 | 0.0 | 6.0 | 30.2 | 2.0 | bal | 0.90 | 2.47 | 0.210 | 0.96 | 0.20 | 0.20 | 0.20 | 0.03 | 0.15 | 900 | 500 | 500 |
| 44 | 18.5 | 6.2 | 0.0 | 5.5 | 30.2 | 2.0 | bal. | 0.90 | 2.48 | 0.213 | 0.96 | 0.20 | 0.20 | 0.20 | 0.03 | 0.15 | 900 | 500 | 500 |
| 45 | 18.9 | 6.3 | 0.0 | 5.0 | 30.2 | 2.0 | bal. | 0.90 | 2.48 | 0.216 | 0.96 | 0.20 | 0.20 | 0.20 | 0.03 | 0.15 | 900 | 500 | 500 |
| 46 | 19.3 | 6.4 | 0.0 | 4.5 | 30.2 | 2.0 | bal. | 0.90 | 2.49 | 0.219 | 0.96 | 0.20 | 0.20 | 0.20 | 0.03 | 0.15 | 900 | 500 | 500 |
| 47 | 19.6 | 6.6 | 0.0 | 4.0 | 30.2 | 2.0 | bal. | 0.90 | 2.49 | 0.226 | 0.96 | 0.20 | 0.20 | 0.20 | 0.03 | 0.15 | 900 | 500 | 500 |
| 48 | 20.0 | 6.7 | 0.0 | 3.5 | 30.2 | 2.0 | bal. | 0.90 | 2.50 | 0.229 | 0.96 | 0.20 | 0.20 | 0.20 | 0.03 | 0.15 | 900 | 500 | 500 |
| 49 | 20.4 | 6.6 | 0.0 | 3.0 | 30.2 | 2.0 | bal. | 0.90 | 2.50 | 0.232 | 0.96 | 0.20 | 0.20 | 0.20 | 0.03 | 0.15 | 900 | 500 | 500 |
| 50 | 20.8 | 6.9 | 0.0 | 2.5 | 30.2 | 2.0 | bal. | 0.90 | 2.51 | 0.235 | 0.96 | 0.20 | 0.20 | 0.20 | 0.03 | 0.15 | 900 | 500 | 500 |
| 51 | 21.9 | 7.3 | 0.0 | 1.0 | 30.2 | 2.0 | bal. | 0.90 | 2.52 | 0.247 | 0.96 | 0.20 | 0.20 | 0.20 | 0.03 | 0.15 | 900 | 500 | 500 |
| *52 | 22.3 | 7.4 | 0.0 | ***0.5*** | 30.2 | 2.0 | bal. | 0.90 | 2.53 | ***0.250*** | 0.96 | 0.20 | 0.20 | 0.20 | 0.03 | 0.15 | 900 | 500 | 500 |
| *53 | 16.6 | 5.6 | 0.0 | 7.5 | 29.7 | 2.0 | bal. | 0.90 | 2.41 | 0.198 | 0.95 | 0.20 | 0.20 | 0.20 | 0.03 | 0.15 | 900 | 500 | 500 |
| 54 | 17.4 | 5.8 | 0.0 | 6.5 | 29.7 | 2.0 | bal. | 0.90 | 2.42 | 0.204 | 0.95 | 0.20 | 0.20 | 0.20 | 0.03 | 0.15 | 900 | 500 | 500 |
| 55 | 17.8 | 5.9 | 0.0 | 6.0 | 29.7 | 2.0 | bal. | 0.90 | 2.46 | 0.207 | 0.95 | 0.20 | 0.20 | 0.20 | 0.03 | 0.15 | 900 | 500 | 500 |
| 56 | 18.1 | 6.1 | 0.0 | 5.5 | 29.7 | 2.0 | bal. | 0.90 | 2.43 | 0.214 | 0.95 | 0.20 | 0.20 | 0.20 | 0.03 | 0.15 | 900 | 500 | 500 |
| 57 | 18.5 | 6.2 | 0.0 | 5.0 | 29.7 | 2.0 | bal. | 0.90 | 2.44 | 0.217 | 0.95 | 0.20 | 0.20 | 0.20 | 0.03 | 0.15 | 900 | 500 | 500 |
| 58 | 18.9 | 6.3 | 0.0 | 4.5 | 29.7 | 2.0 | bal. | 0.90 | 2.44 | 0.220 | 0.95 | 0.20 | 0.20 | 0.20 | 0.03 | 0.15 | 900 | 500 | 500 |
| 59 | 19.3 | 6.4 | 0.0 | 4.0 | 29.7 | 2.0 | bal. | 0.90 | 2.45 | 0.223 | 0.95 | 0.20 | 0.20 | 0.20 | 0.03 | 0.15 | 900 | 500 | 500 |
| 60 | 19.6 | 6.6 | 0.0 | 3.5 | 29.7 | 2.0 | bal | 0.90 | 2.45 | 0.229 | 0.95 | 0.20 | 0.20 | 0.20 | 0.03 | 0.15 | 900 | 500 | 500 |
| 61 | 20.0 | 6.7 | 0.0 | 3.0 | 29.7 | 2.0 | bal. | 0.90 | 2.46 | 0.232 | 0.95 | 0.20 | 0.20 | 0.20 | 0.03 | 0.15 | 900 | 500 | 500 |
| 62 | 20.4 | 6.8 | 0.0 | 2.5 | 29.7 | 2.0 | bal. | 0.90 | 2.46 | 0.235 | 0.95 | 0.20 | 0.20 | 0.20 | 0.03 | 0.15 | 900 | 500 | 500 |
| 63 | 21.5 | 7.2 | 0.0 | 1.0 | 29.7 | 2.0 | bal. | 0.90 | 2.48 | 0.248 | 0.95 | 0.20 | 0.20 | 0.20 | 0.03 | 0.15 | 900 | 500 | 500 |
| *64 | 21.9 | 7.3 | 0.0 | ***0.5*** | 29.7 | 2.0 | bal. | 0.90 | 2.48 | ***0.251*** | 0.95 | 0.20 | 0.20 | 0.20 | 0.03 | 0.15 | 900 | 500 | 500 |
| *65 | 16.1 | 5.4 | 0.0 | ***7.0*** | 28.5 | 2.0 | bal. | 0.90 | 2.32 | 0.199 | 0.93 | 0.20 | 0.20 | 0.20 | 0.03 | 0.15 | 900 | 500 | 500 |
| 66 | 16.5 | 5.5 | 0.0 | 6.5 | 28.5 | 2.0 | bal. | 0.90 | 2.32 | 0.202 | 0.93 | 0.20 | 0.20 | 0.20 | 0.03 | 0.15 | 900 | 500 | 500 |
| 67 | 16.9 | 5.6 | 0.0 | 6.0 | 28.5 | 2.0 | bal. | 0.90 | 2.33 | 0.205 | 0.93 | 0.20 | 0.20 | 0.20 | 0.03 | 0.15 | 900 | 500 | 500 |
| 68 | 17.2 | 5.8 | 0.0 | 5.5 | 26.5 | 2.0 | bal. | 0.90 | 266 | 0.212 | 0.93 | 0.20 | 0.20 | 0.20 | 0.03 | 0.15 | 900 | 500 | 500 |
| 69 | 17.6 | 5.9 | 0.0 | 5.0 | 28.5 | 2.0 | bal. | 0.90 | 2.34 | 0.215 | 0.93 | 0.20 | 0.20 | 0.20 | 0.03 | 0.15 | 900 | 500 | 500 |
| 70 | 18.0 | 6.0 | 0.0 | 4.5 | 28.5 | 2.0 | bal. | 0.90 | 2.34 | 0.218 | 0.93 | 0.20 | 0.20 | 0.20 | 0.03 | 0.15 | 900 | 500 | 500 |
| 71 | 18.4 | 6.1 | 0.0 | 4.0 | 28.5 | 2.0 | bal. | 0.90 | 2.35 | 0.221 | 0.93 | 0.20 | 0.20 | 0.20 | 0.03 | 0.15 | 900 | 500 | 500 |
| 72 | 18.7 | 6.3 | 0.0 | 3.5 | 28.5 | 2.0 | bal. | 0.90 | 2.35 | 0.228 | 0.93 | 0.20 | 0.20 | 0.20 | 0.03 | 0.15 | 900 | 500 | 500 |
| 73 | 19.1 | 6.4 | 0.0 | 3.0 | 28.5 | 2.0 | bal. | 0.90 | 2.36 | 0.231 | 0.93 | 0.20 | 0.20 | 0.20 | 0.03 | 0.15 | 900 | 500 | 500 |
| 74 | 19.5 | 6.5 | 0.0 | 2.5 | 28.5 | 2.0 | bal. | 0.90 | 2.36 | 0.234 | 0.93 | 0.20 | 0.20 | 0.20 | 0.03 | 0.15 | 900 | 500 | 500 |
| *75 | 21.0 | 7.0 | 0.0 | ***0.5*** | 28.5 | 2.0 | bal. | 0.90 | 2.38 | ***0.250*** | 0.93 | 0.20 | 0.20 | 0.20 | 0.03 | 0.15 | 900 | 500 | 500 |
| *76 | 15.4 | 5.1 | 0.0 | ***7.5*** | 28.0 | 2.0 | bal. | 0.90 | 2.27 | 0.191 | 0.93 | 0.20 | 0.20 | 0.20 | 0.03 | 0.15 | 900 | 500 | 500 |
| 77 | 16.1 | 5.4 | 0.0 | 6.5 | 28.0 | 2.0 | bal. | 0.90 | 2.28 | 0.202 | 0.93 | 0.20 | 0.20 | 0.20 | 0.03 | 0.15 | 900 | 500 | 500 |
| 78 | 16.5 | 5.5 | 0.0 | 6.0 | 28.0 | 2.0 | bal. | 0.90 | 2.29 | 0.205 | 0.93 | 0.20 | 0.20 | 0.20 | 0.03 | 0.15 | 900 | 500 | 500 |
| 79 | 16.9 | 5.6 | 0.0 | 5.5 | 28.0 | 2.0 | bal. | 0.90 | 2.29 | 0.208 | 0.93 | 0.20 | 0.20 | 0.20 | 0.03 | 0.15 | 900 | 500 | 500 |
| 80 | 17.2 | 5.8 | 0.0 | 5.0 | 28.0 | 2.0 | bal. | 0.90 | 2.30 | 0.215 | 0.93 | 0.20 | 0.20 | 0.20 | 0.03 | 0.15 | 900 | 500 | 500 |
| 81 | 17.6 | 5.9 | 0.0 | 4.5 | 28.0 | 2.0 | bal. | 0.90 | 2.30 | 0.219 | 0.93 | 0.20 | 0.20 | 0.20 | 0.03 | 0.15 | 900 | 500 | 500 |
| 82 | 18.0 | 6.0 | 0.0 | 4.0 | 28.0 | 2.0 | bal. | 0.90 | 2.31 | 0.222 | 0.93 | 0.20 | 0.20 | 0.20 | 0.03 | 0.15 | 900 | 500 | 500 |
| 83 | 18.4 | 6.1 | 0.0 | 3.5 | 28.0 | 2.0 | bal. | 0.90 | 2.31 | 0.225 | 0.93 | 0.20 | 0.20 | 0.20 | 0.03 | 0.15 | 900 | 500 | 500 |
| 84 | 18.7 | 6.3 | 0.0 | 3.0 | 28.0 | 2.0 | bal. | 0.90 | 2.32 | 0.232 | 0.93 | 0.20 | 0.20 | 0.20 | 0.03 | 0.15 | 900 | 500 | 500 |

TABLE 3-continued

| | R-T-B based sntered magnet composition (before Tb diffusion) | | | | | | | | | | | | | | | | | | |
|---|---|---|---|---|---|---|---|---|---|---|---|---|---|---|---|---|---|---|---|
| | R | | | | | T | | | TRE/B | Pr/TRE | 14B/ | M | | | | | | | |
| Sample No. | Nd (mass %) | Pr (mass %) | Tb (mass %) | Dy (mass %) | TRE (mass %) | Co (mass %) | Fe mass %) | B (mass %) | (atomic rato) | (atomic rato) | (Fe + Co) (mass %) | Al (mass %) | Ga (mass %) | Cu (mass %) | Mn (mass %) | Zr (mass %) | C (ppm) | N (ppm) | O (ppm) |
| 85 | 19.1 | 6.4 | 0.0 | 2.5 | 28.0 | 2.0 | bal | 0.90 | 2.32 | 0.235 | 0.93 | 0.20 | 0.20 | 0.20 | 0.03 | 0.15 | 900 | 500 | 500 |
| *86 | 20.6 | 6.9 | 0.3 | ***0.5*** | 28.0 | 2.0 | fca | 0.90 | 2.34 | ***0.251*** | 0.93 | 0.20 | 0.20 | 0.20 | 0.03 | 0.15 | 900 | 500 | 500 |

*indicates comparative example

TABLE 4

| | Before Tb dffusion | | | | | | | Difference due to Tb diffusion | | After Tb diffusion | | | | | |
|---|---|---|---|---|---|---|---|---|---|---|---|---|---|---|---|
| | | | | | Demagnetization factor | | | | | | | | | Demagnetization factor | |
| Sample No. | Br MT | HcJ (kA/m) | PI | Hk/HcJ (%) | at high temperature (%) | PI, Hk/HcJ Evaluation | Corrosion resistance | Δ Br (mT) | Δ HcJ (kA/m) | Br (mT) | HcJ (kA/m) | PI | Hk/HcJ (%) | at high temperature (%) | PI, Hl/HcJ Evaluation |
| *41 | ***1216*** | 2604 | ***1625*** | 98.5 | 0 | X | ◎ | −7 | 739 | ***1209*** | 3343 | ***1734*** | 98.3 | 0 | ***x*** |
| 42 | 1249 | 2431 | 1631 | 99.5 | 0 | ○ | ◎ | −8 | 755 | 1241 | 3186 | 1741 | 97.6 | 0 | ○ |
| 43 | 1265 | 2342 | 1633 | 99.6 | 0 | ○ | ◎ | −6 | 725 | 1259 | 3067 | 1741 | 96.8 | 0 | ○ |
| 44 | 1280 | 2241 | 1632 | 99.7 | 0 | ○ | ◎ | −7 | 756 | 1273 | 2997 | 1744 | 98.5 | 0 | ○ |
| 45 | 1297 | 2147 | 1634 | 99.4 | −3 | ○ | ◎ | −7 | 754 | 1290 | 2901 | 1746 | 97.9 | 0 | ○ |
| 46 | 1309 | 2061 | 1633 | 99.0 | −9 | ○ | ◎ | −7 | 731 | 1302 | 2792 | 1741 | 96.8 | 0 | ○ |
| 47 | 1327 | 1970 | 1636 | 98.9 | −16 | ○ | ◎ | −6 | 743 | 1321 | 2713 | 1747 | 99.5 | 0 | ○ |
| 48 | 1340 | 1890 | 1637 | 99.2 | −22 | ○ | ◎ | −7 | 735 | 1333 | 2625 | 1745 | 98.1 | 0 | ○ |
| 49 | 1358 | 1794 | 1640 | 98.9 | −28 | ○ | ◎ | −7 | 715 | 1351 | 2509 | 1745 | 96.8 | 0 | ○ |
| 50 | 1373 | 1707 | 1641 | 99.0 | −34 | ○ | ◎ | −7 | 735 | 1366 | 2442 | 1750 | 98.9 | 0 | ○ |
| 51 | 1420 | 1439 | 1646 | 98.9 | 52 | ○ | ◎ | −7 | 722 | 1413 | 2161 | 1752 | 97.6 | −7 | ○ |
| *52 | 1434 | ***1340*** | 1644 | 98.5 | −58 | X | ○ | −7 | 725 | 1427 | ***2068*** | 1752 | 97.6 | −13 | ○ |
| *53 | ***1235*** | 2570 | 1636 | 98.5 | 0 | X | ◎ | −8 | 765 | ***1227*** | 3335 | 1751 | 96.8 | 0 | ○ |
| 54 | 1266 | 2392 | 1642 | 99.5 | 0 | ○ | ◎ | −8 | 741 | 1258 | 3133 | 1750 | 98.8 | 0 | ○ |
| 55 | 1280 | 2299 | 1641 | 99.6 | 0 | ○ | ◎ | −8 | 779 | 1272 | 3078 | 1755 | 97.7 | 0 | ○ |
| 56 | 1297 | 2205 | 1643 | 99.7 | 0 | ○ | ◎ | −3 | 759 | 1289 | 2964 | 1755 | 98.6 | 0 | ○ |
| 57 | 1313 | 2125 | 1647 | 99.4 | −5 | ○ | ◎ | −7 | 758 | 1306 | 2883 | 1759 | 96.6 | 0 | ○ |
| 58 | 1328 | 2028 | 1647 | 99.0 | −12 | ○ | ◎ | −8 | 741 | 1320 | 2769 | 1755 | 99.2 | 0 | ○ |
| 59 | 1339 | 1937 | 1643 | 98.9 | −18 | ○ | ◎ | −7 | 757 | 1332 | 2694 | 1755 | 97.3 | 0 | ○ |
| 60 | 1360 | 1857 | 1652 | 99.2 | −24 | ○ | ◎ | −8 | 761 | 1352 | 2618 | 1763 | 98.1 | 0 | ○ |
| 61 | 1375 | 1759 | 1651 | 98.9 | −31 | ○ | ◎ | −8 | 781 | 1367 | 2540 | 1766 | 96.7 | 0 | ○ |
| 62 | 1389 | 1673 | 1652 | 99.0 | −37 | ○ | ◎ | −8 | 766 | 1381 | 2439 | 1764 | 98.4 | 0 | ○ |
| 63 | 1435 | 1407 | 1656 | 98.9 | −54 | ○ | ◎ | −8 | 770 | 1427 | 2177 | 1769 | 98.5 | −6 | ○ |
| *64 | 1451 | ***1320*** | 1658 | 98.5 | −59 | X | ○ | −8 | 784 | 1443 | ***2104*** | 1773 | 97.8 | −11 | ○ |
| *65 | 1256 | 2375 | ***1629*** | 99.5 | 0 | X | ◎ | −10 | 760 | 1246 | 3135 | ***1738*** | 97.1 | 0 | ***x*** |
| 66 | 1273 | 2301 | 1634 | 99.5 | 0 | ○ | ◎ | −9 | 740 | 1264 | 3041 | 1742 | 96.7 | 0 | ○ |
| 67 | 1289 | 2202 | 1635 | 99.6 | 0 | ○ | ◎ | −8 | 749 | 1281 | 2951 | 1745 | 97.0 | 0 | ○ |
| 68 | 1305 | 2108 | 1636 | 99.7 | −6 | ○ | ◎ | −10 | 767 | 1295 | 2875 | 1747 | 98.4 | 0 | ○ |
| 69 | 1321 | 2018 | 1638 | 99.4 | −12 | ○ | ◎ | −8 | 741 | 1313 | 2759 | 1746 | 96.9 | 0 | ○ |
| 70 | 1335 | 1922 | 1637 | 99.0 | −19 | ○ | ◎ | −10 | 748 | 1325 | 2670 | 1744 | 97.5 | 0 | ○ |
| 71 | 1351 | 1840 | 1640 | 98.9 | −25 | ○ | ◎ | −8 | 775 | 1343 | 2615 | 1754 | 98.8 | 0 | ○ |
| 72 | 1367 | 1755 | 1643 | 99.2 | −31 | ○ | ◎ | −9 | 738 | 1358 | 2493 | 1750 | 98.1 | 0 | ○ |
| 73 | 1380 | 1659 | 1641 | 98.9 | −33 | ○ | ◎ | −9 | 750 | 1371 | 2409 | 1749 | 97.5 | 0 | ○ |
| 74 | 1396 | 1569 | 1643 | 99.0 | −43 | ○ | ◎ | −9 | 749 | 1387 | 2318 | 1751 | 98.8 | 0 | ○ |
| *75 | 1460 | ***1211*** | 1650 | 98.5 | −66 | X | ○ | −9 | 759 | 1451 | ***1970*** | 1760 | 97.3 | −20 | ○ |
| *76 | 1246 | 2417 | ***1626*** | 98.5 | 0 | X | ◎ | −9 | 743 | 1237 | 3160 | ***1733*** | 99.0 | 0 | ***x*** |
| 77 | 1276 | 2263 | 1631 | 99.5 | 0 | ○ | ◎ | −9 | 761 | 1267 | 3024 | 1742 | 97.7 | 0 | ○ |
| 78 | 1292 | 2162 | 1632 | 99.6 | −1 | ○ | ◎ | −9 | 754 | 1283 | 2916 | 1741 | 99.8 | 0 | ○ |
| 79 | 1306 | 2068 | 1631 | 99.7 | −8 | ○ | ◎ | −10 | 764 | 1296 | 2832 | 1741 | 98.5 | 0 | ○ |
| 80 | 1324 | 1974 | 1634 | 99.4 | −15 | ○ | ◎ | −8 | 735 | 1316 | 2709 | 1742 | 98.5 | 0 | ○ |
| 81 | 1338 | 1875 | 1633 | 99.0 | −22 | ○ | ◎ | −10 | 762 | 1328 | 2640 | 1743 | 97.9 | 0 | ○ |
| 82 | 1356 | 1799 | 1639 | 98.9 | −28 | ○ | ◎ | −9 | 754 | 1347 | 2553 | 1748 | 99.5 | 0 | ○ |
| 83 | 1370 | 1713 | 1639 | 99.2 | −34 | ○ | ◎ | −9 | 742 | 1361 | 2455 | 1747 | 98.1 | 0 | ○ |
| 84 | 1382 | 1617 | 1636 | 98.9 | −40 | ○ | ◎ | −9 | 741 | 1373 | 2358 | 1743 | 96.7 | 0 | ○ |

TABLE 4-continued

| | Before Tb dffusion | | | | | | | Difference due to Tb diffusion | | After Tb diffusion | | | | | |
|---|---|---|---|---|---|---|---|---|---|---|---|---|---|---|---|
| | | | | | Demagnetization factor | | | | | | | | | Demagnetization factor | |
| Sample No. | Br MT | HcJ (kA/m) | PI | Hk/HcJ (%) | at high temperature (%) | PI, Hk/HcJ Evaluation | Corrosion resistance | Δ Br (mT) | Δ HcJ (kA/m) | Br (mT) | HcJ (kA/m) | PI | Hk/HcJ (%) | at high temperature (%) | PI, Hl/HcJ Evaluation |
| 85 | 1399 | 1526 | 1639 | 99.0 | −46 | ○ | ◎ | −8 | 747 | 1391 | 2273 | 1748 | 99.2 | 0 | ○ |
| *86 | 1464 | ***1166*** | 1647 | 98.5 | −69 | X | ○ | −10 | 741 | 1454 | ***1907*** | 1754 | 99.0 | −24 | ○ |

*indicates comparative example

Δ Br = (Br after Tb diffusion) − (Br before Tb diffusion)

Δ HcJ = (HcJ after Tb diffusion) − (HcJ before Tb diffusion)

TABLE 5

| | R-T-B based sintered magnet composition (before Tb diffusion) | | | | | | | | | | | | | | | | |
|---|---|---|---|---|---|---|---|---|---|---|---|---|---|---|---|---|---|
| | R | | | | | | T | | | M | | | | | | | |
| Sample No. | Nd (mass %) | Pr (mass %) | Tb (mass %) | Dy (mass %) | TRE (mass %) | Pr/TRE (atomic ratio) | Co (mass %) | Fe (mass %) | B (mass %) | Al (mass %) | Ga (mass %) | Cu (mass %) | Mn (mass %) | Zr (mass %) | C (ppm) | N (ppm) | O (ppm) |
| 91 | 19.8 | 6.6 | 0.0 | 3.3 | 29.7 | 0.229 | 0.5 | bal. | 0.93 | 0.20 | 0.20 | 0.20 | 0.03 | 0.15 | 900 | 500 | 500 |
| 92 | 19.8 | 6.8 | 0.0 | 3.3 | 29.7 | 0.229 | 1.0 | bal. | 0.93 | 0.20 | 0.20 | 0.20 | 0.03 | 0.15 | 900 | 500 | 500 |
| 17 | 19.8 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 94 | 19.8 | 6.6 | 0.0 | 3.3 | 29.7 | 0.229 | 3.0 | bal. | 0.93 | 0.20 | 0.20 | 0.20 | 0.03 | 0.15 | 900 | 500 | 500 |
| 95 | 19.3 | 6.6 | 0.0 | 3.3 | 29.7 | 0.229 | 2.0 | bal. | 0.93 | 0.15 | 0.20 | 0.20 | 0.03 | 0.15 | 900 | 500 | 500 |
| 17 | 13.8 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 97 | 19.8 | 6.6 | 0.0 | 3.3 | 29.7 | 0.229 | 2.0 | bal. | 0.93 | 0.25 | 0.20 | 0.20 | 0.03 | 0.15 | 900 | 500 | 500 |
| 98 | 19.3 | 6.6 | 0.0 | 3.3 | 29.7 | 0.229 | 2.0 | bal. | 0.93 | 0.30 | 0.20 | 0.20 | 0.03 | 0.15 | 900 | 500 | 500 |
| 99 | 19.8 | 6.6 | 0.0 | 3.3 | 29.7 | 0.229 | 2.0 | bal. | 0.93 | 0.20 | 0.20 | 0.04 | 0.03 | 0.15 | 900 | 500 | 500 |
| 100 | 19.8 | 6.6 | 0.0 | 3.3 | 29.7 | 0.229 | 2.0 | bal. | 0.93 | 0.20 | 0.20 | 0.10 | 0.03 | 0.15 | 900 | 500 | 500 |
| 17 | 19.3 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 102 | 19.8 | 6.6 | 0.0 | 3.3 | 29.7 | 0.229 | 2.0 | bal. | 0.93 | 0.20 | 0.20 | 0.30 | 0.03 | 0.15 | 900 | 500 | 500 |
| 103 | 19.3 | 6.5 | 0.0 | 3.3 | 29.7 | 0.229 | 2.0 | bal. | 0.93 | 0.20 | 0.20 | 0.50 | 0.03 | 0.15 | 900 | 500 | 500 |
| 104 | 19.8 | 6.6 | 0.0 | 3.3 | 29.7 | 0.229 | 2.0 | bal. | 0.93 | 0.20 | 0.08 | 0.20 | 0.03 | 0.15 | 900 | 500 | 500 |
| 105 | 19.8 | 6.6 | 0.0 | 3.3 | 29.7 | 0.229 | 2.0 | bal. | 0.93 | 0.20 | 0.10 | 0.20 | 0.03 | 0.15 | 900 | 500 | 500 |
| 17 | 19.8 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 106 | 19.8 | 6.6 | 0.0 | 3.3 | 29.7 | 0.229 | 2.0 | bal. | 0.93 | 0.20 | 0.25 | 0.20 | 0.03 | 0.15 | 900 | 500 | 500 |
| 107 | 19.3 | 6.6 | 0.0 | 3.3 | 29.7 | 0.229 | 2.0 | bal. | 0.93 | 0.20 | 0.30 | 0.20 | 0.03 | 0.15 | 900 | 500 | 500 |
| 109 | 19.3 | 6.6 | 0.0 | 3.3 | 29.7 | 0.229 | 2.0 | bal. | 0.93 | 0.20 | 0.20 | 0.20 | 0.03 | 0.10 | 900 | 500 | 500 |
| 17 | 19.8 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 111 | 19.8 | 6.6 | 0.0 | 3.3 | 29.7 | 0.229 | 2.0 | bal. | 0.93 | 0.20 | 0.20 | 0.20 | 0.03 | 0.25 | 900 | 500 | 500 |
| 112 | 19.3 | 6.6 | 0.0 | 3.3 | 29.7 | 0.229 | 2.0 | bal. | 0.93 | 0.20 | 0.20 | 0.20 | 0.03 | 0.30 | 900 | 500 | 500 |
| 113 | 19.8 | 6.6 | 0.0 | 3.3 | 29.7 | 0.229 | 2.0 | bal. | 0.93 | 0.20 | 0.20 | 0.20 | 0.03 | 0.15 | 600 | 500 | 500 |
| 114 | 19.8 | 6.6 | 0.0 | 3.3 | 29.7 | 0.229 | 2.0 | bal. | 0.93 | 0.20 | 0.20 | 0.20 | 0.03 | 0.15 | 750 | 500 | 500 |
| 17 | 19.3 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 115 | 19.8 | 6.6 | 0.0 | 3.3 | 29.7 | 0.229 | 2.0 | bal. | 0.93 | 0.20 | 0.20 | 0.20 | 0.03 | 0.15 | 1000 | 500 | 500 |
| 116 | 19.3 | 6.6 | 0.0 | 3.3 | 29.7 | 0.229 | 2.0 | bal. | 0.93 | 0.20 | 0.20 | 0.20 | 0.03 | 0.15 | 1100 | 500 | 500 |
| 117 | 19.3 | 6.6 | 0.0 | 3.3 | 29.7 | 0.229 | 2.0 | bal. | 0.93 | 0.20 | 0.20 | 0.20 | 0.03 | 0.15 | 900 | 500 | 350 |
| 118 | 19.3 | 6.6 | 0.0 | 3.3 | 29.7 | 0.229 | 2.0 | bal. | 0.93 | 0.20 | 0.20 | 0.20 | 0.03 | 0.15 | 900 | 500 | 400 |
| 17 | 19.8 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 120 | 19.3 | 6.6 | 0.0 | 3.3 | 29.7 | 0.229 | 2.0 | bal. | 0.93 | 0.20 | 0.20 | 0.20 | 0.03 | 0.15 | 900 | 500 | 800 |
| 121 | 19.3 | 6.6 | 0.0 | 3.3 | 29.7 | 0.229 | 2.0 | bal. | 0.93 | 0.20 | 0.20 | 0.20 | 0.03 | 0.15 | 900 | 500 | 1000 |
| 122 | 19.3 | 6.6 | 0.0 | 3.3 | 29.7 | 0.229 | 2.0 | bal. | 0.93 | 0.20 | 0.20 | 0.20 | 0.03 | 0.15 | 900 | 250 | 500 |
| 123 | 19.8 | 6.6 | 0.0 | 3.3 | 29.7 | 0.229 | 2.0 | bal. | 0.93 | 0.20 | 0.20 | 0.20 | 0.03 | 0.15 | 900 | 300 | 500 |
| 17 | 19.8 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 124 | 19.8 | 6.6 | 0.0 | 3.3 | 29.7 | 0.229 | 2.0 | bal. | 0.93 | 0.20 | 0.20 | 0.20 | 0.03 | 0.15 | 900 | 600 | 500 |
| 125 | 19.8 | 6.6 | 0.0 | 3.3 | 29.7 | 0.229 | 2.0 | bal. | 0.93 | 0.20 | 0.20 | 0.20 | 0.03 | 0.15 | 900 | 700 | 500 |
| 126 | 19.8 | 6.6 | 0.0 | 3.3 | 29.7 | 0.229 | 2.0 | bal. | 0.93 | 0.20 | 0.20 | 0.20 | 0.03 | 0.15 | 900 | 1000 | 500 |
| 127 | 26.4 | 0.0 | 0.0 | 3.3 | 29.7 | 0 | 2.0 | bal. | 0.93 | 0.20 | 0.20 | 0.20 | 0.03 | 0.15 | 900 | 500 | 500 |
| 128 | 21.4 | 5.0 | 0.0 | 3.3 | 29.7 | 0.174 | 2.0 | bal. | 0.93 | 0.20 | 0.20 | 0.20 | 0.03 | 0.15 | 900 | 500 | 500 |
| 17 | 19.8 | 6.6 | 0.0 | 3.3 | 29.7 | 0.229 | 2.0 | bal. | 0.93 | 0.20 | 0.20 | 0.20 | 0.03 | 0.15 | 900 | 500 | 500 |
| 130 | 16.4 | 10.0 | 0.0 | 3.3 | 29.7 | 0.346 | 2.0 | bal. | 0.93 | 0.20 | 0.20 | 0.20 | 0.03 | 0.15 | 900 | 500 | 500 |

TABLE 6

| | Before Tb diffusion | | | | | | | Difference due to Tb diffusion | | After Tb diffusion | | | | | |
|---|---|---|---|---|---|---|---|---|---|---|---|---|---|---|---|
| | | | | | Demagnetization factor | | | | | | | | | Demagnetization factor | |
| Sample No. | Br (mT) | HcJ (kA/m) | PI | Hk/HcJ (%) | at high temperature (%) | PI, Hk/HcJ Evaluation | Corrosion resistance | Δ Br (mT) | Δ HcJ (kA/m) | Br (mT) | HcJ (ka/m) | PI | Hk/HcJ (%) | at high temperature (%) | PI, Hk/HcJ Evaluation |
| 91 | 1372 | 1753 | 1647 | 99.8 | −31 | ○ | ○ | −9 | 766 | 1363 | 2519 | 1759 | 98.1 | 0 | ○ |
| 92 | 1372 | 1762 | 1649 | 99.5 | −31 | ○ | ◎ | −8 | 765 | 1364 | 2527 | 1761 | 98.1 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 94 | 1372 | 1741 | 1645 | 99.5 | −32 | ○ | ◎ | −8 | 762 | 1364 | 2503 | 1757 | 98.0 | 0 | ○ |
| 95 | 1373 | 1754 | 1654 | 99.6 | −31 | ○ | ◎ | −7 | 746 | 1371 | 2500 | 1764 | 97.9 | 0 | ○ |
| 17 | 1369 | 1793 | 1651 | 99.7 | −29 | ○ | ◎ | −8 | 761 | 1361 | 2554 | 1762 | 98.1 | 0 | ○ |
| 97 | 1360 | 1820 | 1646 | 99.5 | −27 | ○ | ◎ | −9 | 770 | 1351 | 2590 | 1758 | 98.1 | 0 | ○ |
| 93 | 1354 | 1842 | 1643 | 99.5 | −25 | ○ | ◎ | −11 | 780 | 1343 | 2622 | 1755 | 97.8 | 0 | ○ |
| 99 | 1375 | 1778 | 1654 | 99.7 | −30 | ○ | ◎ | −9 | 741 | 1366 | 2519 | 1762 | 98.0 | 0 | ○ |
| 100 | 1372 | 1785 | 1652 | 99.5 | −29 | ○ | ◎ | −5 | 752 | 1367 | 2537 | 1766 | 97.7 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 102 | 1368 | 1771 | 1646 | 99.5 | −30 | ○ | ◎ | −7 | 790 | 1361 | 2561 | 1763 | 98.2 | 0 | ○ |
| 103 | 1364 | 1704 | 1632 | 98.5 | −34 | ○ | ◎ | −8 | 811 | 1356 | 2515 | 1751 | 97.6 | 0 | ○ |
| 104 | 1373 | 1769 | 1651 | 99.2 | −30 | ○ | ◎ | −9 | 759 | 1364 | 2528 | 1761 | 98.3 | 0 | ○ |
| 105 | 1371 | 1765 | 1648 | 99.0 | −31 | ○ | ◎ | −9 | 759 | 1362 | 2524 | 1758 | 98.5 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 106 | 1371 | 1793 | 1653 | 99.7 | −29 | ○ | ◎ | −9 | 764 | 1362 | 2557 | 1764 | 98.3 | 0 | ○ |
| 107 | 1369 | 1808 | 1653 | 99.7 | −28 | ○ | ◎ | −8 | 768 | 1361 | 2576 | 1766 | 98.1 | 0 | ○ |
| 109 | 1370 | 1786 | 1651 | 99.5 | −29 | ○ | ◎ | −8 | 766 | 1362 | 2552 | 1763 | 98.0 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 111 | 1367 | 1794 | 1649 | 99.4 | −29 | ○ | ◎ | −11 | 759 | 1356 | 2553 | 1757 | 97.2 | 0 | ○ |
| 112 | 1363 | 1819 | 1649 | 99.2 | −27 | ○ | ◎ | −14 | 741 | 1349 | 2560 | 1751 | 97.2 | 0 | ○ |
| 113 | 1363 | 1835 | 1651 | 96.0 | −26 | ○ | ◎ | −3 | 762 | 1360 | 2597 | 1768 | 95.8 | 0 | ○ |
| 114 | 1367 | 1821 | 1653 | 95.4 | −27 | ○ | ◎ | −8 | 770 | 1359 | 2591 | 1766 | 95.4 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 115 | 1373 | 1785 | 1653 | 99.5 | −29 | ○ | ◎ | −9 | 741 | 1364 | 2526 | 1761 | 98.0 | 0 | ○ |
| 116 | 1376 | 1778 | 1655 | 99.6 | −30 | ○ | ◎ | −11 | 720 | 1365 | 2498 | 1757 | 98.0 | 0 | ○ |
| 117 | 1308 | 1809 | 1652 | 99.5 | −28 | ○ | ◎ | −8 | 747 | 1360 | 2556 | 1761 | 98.2 | 0 | ○ |
| 118 | 1371 | 1804 | 1654 | 99.3 | −28 | ○ | ◎ | −7 | 754 | 1364 | 2558 | 1766 | 97.9 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 120 | 1371 | 1775 | 1650 | 99.5 | −30 | ○ | ◎ | −7 | 784 | 1364 | 2559 | 1766 | 98.0 | 0 | ○ |
| 121 | 1370 | 1753 | 1645 | 99.2 | −31 | ○ | ◎ | −8 | 791 | 1362 | 2544 | 1762 | 98.0 | 0 | ○ |
| 122 | 1368 | 1808 | 1652 | 99.8 | −28 | ○ | ◎ | −7 | 780 | 1361 | 2588 | 1768 | 98.1 | 0 | ○ |
| 123 | 1370 | 1808 | 1654 | 99.7 | −28 | ○ | ◎ | −8 | 778 | 1362 | 2586 | 1768 | 98.2 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 124 | 1372 | 1785 | 1652 | 99.6 | −29 | ○ | ◎ | −9 | 749 | 1363 | 2534 | 1761 | 98.0 | 0 | ○ |
| 125 | 1371 | 1776 | 1650 | 99.3 | −30 | ○ | ◎ | −9 | 735 | 1362 | 2511 | 1756 | 98.0 | 0 | ○ |
| 126 | 1368 | 1758 | 1644 | 99.1 | −31 | ○ | ◎ | −7 | 725 | 1361 | 2483 | 1751 | 98.0 | 0 | ○ |
| 127 | 1371 | 1775 | 1650 | 99.6 | −30 | ○ | ◎ | −7 | 760 | 1364 | 2535 | 1762 | 98.2 | 0 | ○ |

TABLE 6-continued

| | Before Tb diffusion | | | | | | | Difference due to Tb diffusion | | After Tb diffusion | | | | | |
|---|---|---|---|---|---|---|---|---|---|---|---|---|---|---|---|
| | | | | | Demagnetization factor | | | | | | | | | Demagnetization factor | |
| Sample No. | Br (mT) | HcJ (kA/m) | PI | Hk/HcJ (%) | at high temperature (%) | PI, Hk/HcJ Evaluation | Corrosion resistance | Δ Br (mT) | Δ HcJ (kA/m) | Br (mT) | HcJ (ka/m) | PI | Hk/HcJ (%) | at high temperature (%) | PI, Hk/HcJ Evaluation |
| 128 | 1369 | 1781 | 1649 | 99.6 | −29 | ○ | ◎ | −7 | 758 | 1362 | 2539 | 1761 | 98.1 | 0 | ○ |
| 17 | 1370 | 1789 | 1651 | 99.7 | −29 | ○ | ◎ | −8 | 761 | 1362 | 2550 | 1763 | 98.1 | 0 | ○ |
| 130 | 1369 | 1804 | 1652 | 99.7 | −28 | ○ | ◎ | −8 | 763 | 1361 | 2567 | 1764 | 98.1 | 0 | ○ |

Δ Br = (Br after Tb diffusion) − (Br before Tb diffusion)
Δ HcJ = (HcJ after Tb diffusion) − (HcJ before Tb diffusion)

In Table 1, TRE and B were varied. Also, Nd and Pr were included so that the mass ratio of Nd and Pr were approximately 3:1. Results are shown in Table 2. In Table 3, TRE and Dy were varied. Results are shown in Table 4. For the sample numbers 91 to 126 shown in Table 5, the contents of components other than R and B were varied. Also, for the sample numbers 127 to 130 shown in Table 5, the content of TRE and Dy were fixed, and the content of Nd and Pr were varied. Results are shown in Table 6.

According to Tables 1 to 6, in all Examples, Br, HcJ, PI, the squareness ratio, and the corrosion resistance before Tb diffusion were good. Moreover, in all Examples, Br, HcJ, PI, and the squareness ratio after Tb diffusion were also good. On the other hand, in all Comparative Examples, at least one of Br, HcJ, PI, and the squareness ratio before Tb diffusion as well as Br, HcJ, PI, and the squareness ratio after Tb diffusion was not good.

The example having the content of Dy of 2.5 mass % or more and 6.5 mass % or less tended to have good demagnetization factor at high temperature.

The example having the content of Co of 1.0 mass % or more, the content of Cu of 0.10 mass % or more, and Pr/TRE of less than 0.250 tended to have good corrosion resistance.

Further, the example having the content of C of 900 ppm to 1100 ppm tended to have good squareness ratio.

Also, for the R-T-B based permanent magnet after diffusion of Tb shown in Tables 1 to 6, Tb concentration distribution was measured using an electron probe micro analyzer (EPMA). As a result, it was confirmed that Tb concentration decreases from outside to inside of the R-T-B based permanent magnets after Tb diffusion.

The invention claimed is:

1. An R-T-B based permanent magnet comprising M, wherein,

R is a rare earth element, T is Fe and Co, and B is boron, R at least includes Dy, M is one or more elements selected from Cu, Ga, Al, Mn, Zr, T1, Cr, Ni, Nb, Ag, Hf, Ta, W, Si, Bi, and Sn, M at least includes Cu and Mn, relative to 100 mass % of the total mass of R, T, B, and M, a total content of R is 29.2 mass % to 30.2 mass %, a content of Dy is 2.5 mass % to 6.5 mass %, a content of Cu is 0.04 mass % to 0.50 mass %, a content of Ga is 0.25 mass % to 0.30 mass %, a content of Mn is 0.02 mass % to 0.10 mass %, a content of Co is 1.0 mass % to 2.0 mass %, and a content of B is 0.85 mass % to 0.95 mass %, a content of O in the R-T-B based permanent magnet is 350 ppm or more to 800 ppm or less, and a content of C in the R-T-B based permanent magnet is 900 ppm or more to 1100 ppm or less, and wherein, the magnet has the following properties before diffusion of a heavy rare earth element:

Br≥1240 mT, HcJ≥1400 kA/m, PI≥1630 and Hk/HcJ≥95.0%, in which Br represents residual magnetic flux density, HcJ represents coercivity, PI represents performance index and is calculated by the equation $PI=Br+25\times HcJ\times 4\pi/2{,}000$, and Hk/HcJ represents the squareness ratio.

2. The R-T-B based permanent magnet according to claim 1, wherein R at least includes Nd.

3. The R-T-B based permanent magnet according to claim 2, wherein R at least includes Pr, and a content of Pr is more than 0 and 10.0 mass % or less.

4. The R-T-B based permanent magnet according to claim 3, wherein an atomic ratio of TRE/B is 2.19 to 2.60, where TRE is the total content of R.

5. The R-T-B based permanent magnet according to claim 2, wherein an atomic ratio TRE/B is 2.19 to 2.60, where TRE is the total content of R.

6. The R-T-B based permanent magnet according to claim 1, wherein R at least includes Pr, and a content of Pr is more than 0 and 10.0 mass % or less.

7. The R-T-B based permanent magnet according to claim 6, wherein an atomic ratio of TRE/B is 2.19 to 2.60, where TRE is the total content of R.

8. The R-T-B based permanent magnet according to claim 1, wherein an atomic ratio of TRE/B is 2.19 to 2.60, where TRE is the total content of R.

9. The R-T-B based permanent magnet according to claim 1, wherein an atomic ratio of Pr/TRE is 0 or more and less than 0.25, where TRE is the total content of R.

10. The R-T-B based permanent magnet according to claim 1, wherein an atomic ratio of 14B/(Fe+Co) is larger than 0 and 1.01 or less.

11. An R-T-B based permanent magnet in which the R-T-B based permanent magnet according to claim 1 has been subjected to diffusion of a heavy rare earth element.

* * * * *